US008247154B2

(12) United States Patent
Kurokawa et al.

(10) Patent No.: US 8,247,154 B2
(45) Date of Patent: Aug. 21, 2012

(54) METHOD FOR PRODUCING TONER

(75) Inventors: Hisashi Kurokawa, Tokyo (JP); Rei Katsuyama, Tokyo (JP); Fuminari Oyama, Tokyo (JP); Hiroto Kidokoro, Tokyo (JP)

(73) Assignee: Zeon Corporation, Tokyo (JP)

( * ) Notice: Subject to any disclaimer, the term of this patent is extended or adjusted under 35 U.S.C. 154(b) by 386 days.

(21) Appl. No.: 12/571,577

(22) Filed: Oct. 1, 2009

(65) Prior Publication Data

US 2010/0081078 A1 Apr. 1, 2010

(30) Foreign Application Priority Data

Oct. 1, 2008 (JP) ..... 2008-256274
Oct. 1, 2008 (JP) ..... 2008-256414

(51) Int. Cl.
*G03G 5/00* (2006.01)

(52) U.S. Cl. ..... 430/137.1; 430/137.15

(58) Field of Classification Search ..... 430/137.1, 430/137.15; 210/386, 396, 401
See application file for complete search history.

(56) References Cited

U.S. PATENT DOCUMENTS

2008/0241730 A1* 10/2008 Tuji et al. ..... 430/137.15
2011/0036769 A1* 2/2011 Homma et al. ..... 210/386

FOREIGN PATENT DOCUMENTS

JP 56-124410 * 9/1981
JP 2007-058201 A 3/2007
JP 2008-112153 A 5/2008

* cited by examiner

*Primary Examiner* — Thorl Chea
(74) *Attorney, Agent, or Firm* — Westerman, Hattori, Daniels & Adrian, LLP

(57) ABSTRACT

The present invention is to provide a method for producing a toner capable of sufficiently decreasing the percentage of moisture content of a wet cake in the process of obtaining colored resin particles in wet state (wet cake), capable of reducing the workload in the following drying process, and thus excellent in productivity. A method for producing a toner comprising the steps of: a process of obtaining an aqueous dispersion of colored resin particles by forming colored resin particles by a wet method; a process of obtaining the colored resin particles in wet state (wet cake) by supplying the aqueous dispersion of the colored resin particles to a belt filter and performing solid-liquid separation; and a process of drying the wet cake, wherein a filter cloth continuous running type belt filter is used as the belt filter in the process of obtaining the wet cake, and the filter cloth continuous running type belt filter has a separation-washing mechanism, in which the aqueous dispersion of the colored resin particles is supplied on a lower filter cloth of the belt filter, the colored resin particles are separated followed by washing, and thus the wet cake is formed, and a pressure-ventilation mechanism, in which the wet cake is covered with an upper filter cloth, the wet cake, disposed between the upper and lower filter cloths, is ventilated while pressure is applied to the wet cake, and thus the wet cake having low percentage of moisture content is obtained.

13 Claims, 2 Drawing Sheets

METHOD FOR PRODUCING TONER

TECHNICAL FIELD

The present invention relates to a method for producing a toner used for development of latent electrostatic images in electrophotography, the electrostatic recording method, the electrostatic printing process or the like. Particularly, the present invention relates to a method for producing a toner capable of reducing the workload in the drying process and excellent in productivity.

BACKGROUND ART

Conventionally, in methods for producing a toner, wet methods including polymerization methods such as the suspension polymerization method, the emulsion polymerization method, and the dispersion polymerization method, solution suspension methods and so on have been employed since the shape of particle diameter, the diameter of particles and the particle size distribution can be easily controlled. Particularly, among the wet methods, the suspension polymerization method is preferably employed since high-quality images can be formed upon printing.

In the method for producing a toner by the suspension polymerization method, which is a representative wet method, a toner is produced through various steps including (1) preparing a polymerizable monomer composition, (2) forming droplets, (3) polymerization, and (4) washing, filtering, dehydrating and drying. Thus, from the viewpoint of improving productivity, reduction in number of production steps and simplification of facilities are considered.

Recently, in the drying step of the wet methods, from the viewpoint of improvement in energy efficiency of dryers, the percentage of moisture content of an object to be dried in a dryer (colored resin particles in a wet state (wet cake)) is required to be sufficiently reduced preliminarily before the drying step without decreasing the productivity of a toner, and various attempts are made.

Japanese Patent Application Laid-Open (JP-A) No. 2007-58201 discloses a method for producing a toner, wherein a series of steps including washing, filtration and dehydration of a slurry containing toner particles produced in a liquid dispersion medium is performed using a filter cloth intermittent motion type belt filter equipped with a squeezing ventilation means to decrease the percentage of moisture content of the wet cake obtained thereby.

Also, JP-A No. 2008-112153 discloses a method for producing a toner, wherein a series of steps including solid-liquid separation, filtration and dehydration of a toner particle dispersion liquid produced in an aqueous dispersion medium is performed using a filter cloth intermittent motion type belt filter equipped with a ventilation means for dehydration by ventilation and a sealing means for sealing the gas subjected to ventilation to decrease the percentage of moisture content of the wet cake obtained thereby.

Though JP-A No. 2007-58201 discloses the result that a wet cake with low percentage of moisture content was obtained by the method for producing a toner of JP-A No. 2007-58201, there is a problem that the slurry is not uniformly supplied on the filter cloth since the filter cloth runs intermittently. Uneven washing of the wet cake can be presumed.

Also, though JP-A No. 2008-112153 discloses the result that a wet cake with low percentage of moisture content was obtained by the method for producing a toner of JP-A No. 2008-112153, there is a problem that the rate of solid-liquid separation decreases since a sealing part needs to be provided as a separate part, which makes the sealing mechanism complicated. Thus, the productivity of the conventional methods for producing a toner cannot reach the level required recently, and further study is required.

SUMMARY OF INVENTION

An object of the present invention is to provide a method for producing a toner capable of sufficiently decreasing the percentage of moisture content of a wet cake in the process of obtaining colored resin particles in wet state (wet cake), capable of reducing the workload in the following drying process, and thus excellent in productivity.

As a result of diligent researches made to attain the above object, the inventors of the present invention have found out that a desired wet cake with low percentage of moisture content can be obtained by using a filter cloth continuous running type belt filter equipped with a specified separation-washing mechanism and a specified pressure-ventilation mechanism in the process of obtaining colored resin particles in wet state (wet cake). Based on the above knowledge, the inventors have reached the present invention.

Specifically, a method for producing a toner of the present invention comprises the steps of: a process of obtaining an aqueous dispersion of colored resin particles by forming the colored resin particles by a wet method; a process of obtaining the colored resin particles in wet state (wet cake) by supplying the aqueous dispersion of the colored resin particles to a belt filter and performing solid-liquid separation; and a process of drying the wet cake, wherein a filter cloth continuous running type belt filter is used as the belt filter in the process of obtaining the wet cake, and the filter cloth continuous running type belt filter has a separation-washing mechanism, in which the aqueous dispersion of the colored resin particles is supplied on a lower filter cloth of the belt filter, the colored resin particles are separated followed by washing, and thus the wet cake is formed, and a pressure-ventilation mechanism, in which the wet cake is covered with an upper filter cloth, the wet cake, disposed between the upper and lower filter cloths, is ventilated while pressure is applied to the wet cake, and thus the wet cake having low percentage of moisture content is obtained.

It is preferable that a ventilation degree of the lower filter cloth of the filter cloth continuous running type belt filter is in the range from 0.1 to 10 $cc/cm^2 \cdot sec$.

It is preferable that tensile strength of the lower filter cloth of the filter cloth continuous running type belt filter is in the range from 150 to 1,200 N/cm in running direction and width direction of the lower filter cloth respectively.

It is preferable that percentage of moisture content of the wet cake formed by the separation-washing mechanism of the method for producing a toner is in the range from 25 to 45 wt %, and average thickness X of the wet cake formed by the separation-washing mechanism is in the range from 1 to 30 mm.

It is preferable that, in the pressure-ventilation mechanism of the method for producing a toner, pressure on a pressurizing surface is in the range from 0.2 to 1.5 MPa.

It is preferable that, in the pressure-ventilation mechanism of the method for producing a toner, an area to ventilate the wet cake is an area excluding 15 mm or more from both edges of the wet cake in a width direction.

It is preferable that, in the pressure-ventilation mechanism, gas used for ventilation is compressed air.

It is preferable that, in the pressure-ventilation mechanism, pressure of gas used for ventilation is 0.2 to 1.5 MPa.

It is preferable that in the pressure-ventilation mechanism, ventilation is performed at pressure of gas used for ventilation of 0.2 to 1.5 MPa for 10 to 150 seconds.

It is preferable that, in the pressure-ventilation mechanism, a relationship between temperature $T_1$ (° C.) of gas used for ventilation and glass-transition temperature Tg (° C.) of the colored resin particles is "Tg−35° C.<$T_1$<Tg+20° C.".

It is preferable that an average percentage of moisture content of the wet cake obtained by the pressure-ventilation mechanism is 20 wt % or less.

It is preferable that electrical conductivity of a filtrate, obtained by dispersing the wet cake obtained by the pressure-ventilation mechanism in ion-exchanged water to prepare a dispersion liquid of the colored resin particles having a concentration of solid content of 20 wt %, and filtering the dispersion liquid, is 0.5 to 20 μS/cm.

According to the present invention as above, a method for producing a toner capable of sufficiently decreasing the percentage of moisture content of a wet cake in the process of obtaining colored resin particles in wet state (wet cake), capable of reducing the workload in the following drying process, and thus excellent in productivity can be provided.

BRIEF DESCRIPTION OF DRAWINGS

In the accompanying drawings.

The signs in the figure refer to the following.

Figure 1:
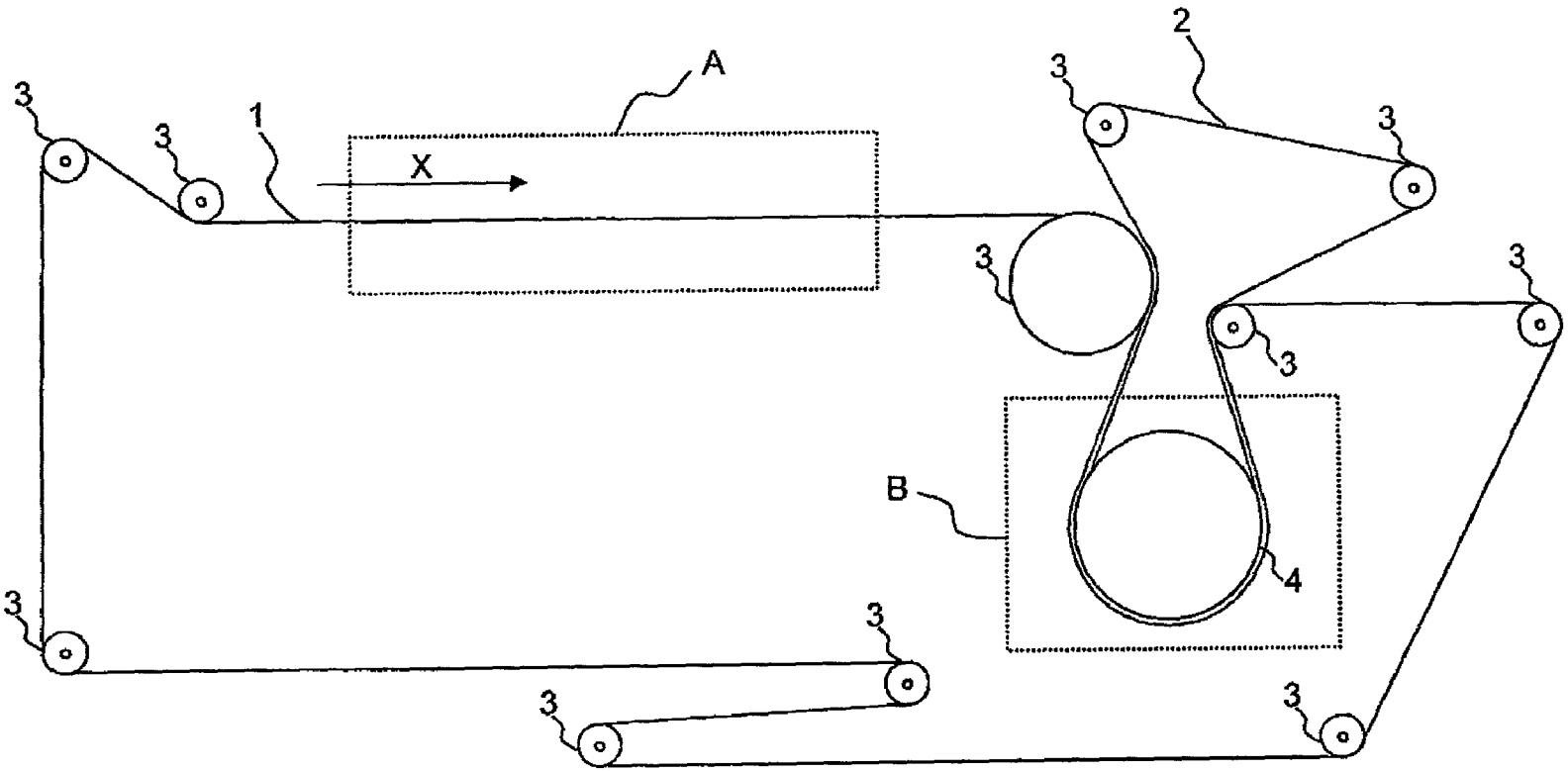
FIG. 1 is a schematic view of a filter cloth continuous running type belt filter of the present invention.

A: separation-washing mechanism; B: pressure-ventilation mechanism; C: wet cake set region; D: ventilation-filtrate discharge region; E: collecting region of a wet cake formed on the upper surface of an upper filter cloth; F: collecting region of a wet cake formed on the upper surface of a lower filter cloth; M: filtrate collecting-supplying mechanism; N: filtrate collecting-supplying mechanism; 1: lower filter cloth; 2: upper filter cloth; 3: roller; 4: press portion roller; and 5: seal belt.

DESCRIPTION OF EMBODIMENTS

A method for producing a toner of the present invention comprises the steps of: a process of obtaining an aqueous dispersion of colored resin particles by forming colored resin particles by a wet method; a process of obtaining colored resin particles in wet state (wet cake) by supplying the aqueous dispersion of colored resin particles to a belt filter and performing solid-liquid separation; and a process of drying the wet cake, wherein a filter cloth continuous running type belt filter is used as the belt filter in the process of obtaining the wet cake, and the filter cloth continuous running type belt filter has a separation-washing mechanism, in which the aqueous dispersion of the colored resin particles is supplied on a lower filter cloth of the belt filter, the colored resin particles are separated followed by washing, and thus the wet cake is formed, and a pressure-ventilation mechanism, in which the wet cake is covered with an upper filter cloth, the wet cake, disposed between the upper and lower filter cloths, is ventilated while pressure is applied to the wet cake, and thus the wet cake having low percentage of moisture content is obtained.

In the present invention, colored resin particles constituting a toner are formed by a wet method. Wet methods include polymerization methods such as the suspension polymerization method, the emulsion polymerization method, and the dispersion polymerization method, and solution suspension methods.

Among the wet methods, the polymerization methods are preferably employed since particle size distribution can be sharp and colored resin particles with small particle diameters can be easily formed. Further, among the polymerization methods, the suspension polymerization method is more preferably employed since colored resin particles having high circularity can be easily formed.

In the present invention, it is preferable to employ the suspension polymerization method. Hereinafter, as a representative example, a method of obtaining an aqueous dispersion of colored resin particles by forming colored resin particles by the suspension polymerization method will be described.

(1) Process of Obtaining Aqueous Dispersion of Colored Resin Particles

This process includes (1-1) Preparation process of polymerizable monomer composition, (1-2) Droplets forming process, and (1-3) Polymerization process. Through all these processes, an aqueous dispersion of colored resin particles can be obtained.

Firstly, a polymerizable monomer, a colorant, and if required, a charge control agent and other additives, are mixed, dissolved or dispersed to prepare a polymerizable monomer composition. Preparation of the polymerizable monomer composition is performed, for example, by means of a media type dispersing machine.

The polymerizable monomer means a monomer having a polymerizable functional group. When the polymerizable monomer is polymerized, a binder resin can be obtained. As a main component of the polymerizable monomer, a monovinyl monomer is preferably used.

Examples of the monovinyl monomer include styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; acrylamide and methacrylamide; and olefins such as ethylene, propylene and butylene. The monovinyl monomer may be used alone or in combination of two or more kinds.

Among the above monovinyl monomers, styrene, styrene derivatives, acrylic acid esters, and methacrylic acid esters are suitably used.

To improve the shelf stability (blocking resistance) of the toner, as a part of the polymerizable monomer, any crosslinkable polymerizable monomer may be used together with the monovinyl monomer. The crosslinkable polymerizable monomer means a monomer having two or more polymerizable functional groups.

As the crosslinkable polymerizable monomer, one which is generally used as a crosslinkable polymerizable monomer for a toner may be used without any particular limitation. Examples of the crosslinkable polymerizable monomer include aromatic divinyl compounds such as divinyl benzene, divinyl naphthalene and derivatives thereof; difunctional ethylenically unsaturated carboxylic acid esters such as ethylene glycol dimethacrylate and diethylene glycol dimethacrylate; divinyl compounds containing a hetero atom such as N,N-divinylaniline and divinyl ether; and compounds having three or more vinyl groups such as trimethylolpropane trimethacrylate and dimethylolpropane tetraacrylate. The crosslinkable polymerizable monomer may be used alone or in combination of two or more kinds.

Alternatively, the crosslinkable polymerizable monomer may be added upon forming droplets in an aqueous dispersion medium in the following "(1-2) Droplets forming process".

In the present invention, it is desirable that the amount of the crosslinkable polymerizable monomer is generally from 0.1 to 5 parts by weight, preferably from 0.3 to 2 parts by weight, with respect to the monovinyl monomer of 100 parts by weight.

To produce a colored toner, in which four types of toners including a black toner, a cyan toner, a yellow toner and a magenta toner are generally used, a black colorant, a cyan colorant, a yellow colorant and a magenta colorant may be respectively used.

As the black colorant, any of the pigments including carbon black, titanium black, magnetic powder such as zinc-ferric oxide and nickel-ferric oxide may be used.

As the cyan colorant, for example, any of the compounds such as copper phthalocyanine pigments, derivatives thereof and anthraquinone pigments may be used. The specific examples include C. I. Pigment Blue 2, 3, 6, 15, 15:1, 15:2, 15:3, 15:4, 16, 17:1 and 60.

As the yellow colorant, any of the compounds including azo pigments such as monoazo pigments and disazo pigments, and condensed polycyclic pigments may be used. The specific examples include C. I. Pigment Yellow 3, 12, 13, 14, 15, 17, 62, 65, 73, 74, 83, 93, 97, 120, 138, 155, 180, 181, 185 and 186.

As the magenta colorant, for example, any of the compounds including azo pigments such as monoazo pigments and disazo pigments, and condensed polycyclic pigments may be used. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209 and 251, and C. I. Pigment Violet 19.

In the present invention, the colorant may be used alone or in combination of two or more kinds. The amount of the colorant is preferably in the range from 1 to 10 parts by weight with respect to the monovinyl monomer of 100 parts by weight.

As other additives, a charge control agent having positively or negatively charging ability can be used to improve the charging ability of the toner.

As the charge control agent, it is not particularly limited if it is a charge control agent generally used for toners. Among charge control agents, a charge control resin having positively or negatively charging ability is preferable since it has high compatibility with the polymerizable monomer, and can impart stable charging ability (charge stability) to toner particles. Further, from the viewpoint of obtaining a positively-chargeable toner, the charge control resin having positively charging ability is more preferably used.

As the charge control resin having positively charging ability, commercial products manufactured by Fujikura Kasei Co., Ltd. may be used including, for example, FCA-161P (product name; styrene/acrylic resin), FCA-207P (product name; styrene/acrylic resin), and FCA-201-PS (product name; styrene/acrylic resin).

As the charge control resin having negatively charging ability, commercial products manufactured by Fujikura Kasei Co., Ltd. may be used including, for example, FCA-626N (product name; styrene/acrylic resin), FCA-748N (product name; styrene/acrylic resin), and FCA-1001N (product name; styrene/acrylic resin).

In the present invention, it is desirable that the amount of the charge control agent is generally in the range from 0.01 to 10 parts by weight, preferably from 0.03 to 8 parts by weight, with respect to the monovinyl monomer of 100 parts by weight.

As one of other additives, the release agent can be used to improve the releasing characteristic of the toner from a fixing roller at fixing.

As the release agent, one which is generally used as a release agent for a toner may be used without any particular limitation. The examples include polyolefin waxes such as low-molecular-weight polyethylene, low-molecular-weight polypropylene and low-molecular-weight polybutylene; natural waxes such as candelilla, carnauba waxes, rice waxes, haze waxes and jojoba; petroleum waxes such as paraffin, microcrystalline and petrolactam; mineral waxes such as montan, ceresin and ozokerite; synthesized waxes such as Fischer-Tropsch waxes; and esterified compounds of polyalcohol including pentaerythritol ester such as pentaerythritol tetramyristate, pentaerythritol tetrapalmitate, pentaerythritol tetrastearate and pentaerythritol tetralaurate, dipentaerythritol ester such as dipentaerythritol hexamyristate, dipentaerythritol hexapalmitate and dipentaerythritol hexylaurate, and polyglyceryl fatty acid ester. These release agents may be used alone or in combination of two or more kinds.

In the present invention, it is desirable that the amount of the release agent is generally in the range from 0.1 to 30 parts by weight, preferably from 1 to 20 parts by weight, with respect to the monovinyl monomer of 100 parts by weight.

As one of other additives, a molecular weight modifier is preferably used to modify molecular weight and molecular weight distribution.

As the molecular weight modifier, one which is generally used as a molecular weight modifier for a toner may be used without any particular limitation. Examples of the molecular weight modifier include mercaptans such as t-dodecylmercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

Alternatively, the molecular weight modifier may be added upon forming droplets of the polymerizable monomer composition in an aqueous dispersion medium in the following "(1-2) Droplets forming process".

In the present invention, it is desirable that the amount of the molecular weight modifier is generally in the range from 0.01 to 10 parts by weight, preferably from 0.1 to 5 parts by weight, with respect to the monovinyl monomer of 100 parts by weight.

(1-2) Droplets Forming Process (Suspension Process of Obtaining Suspension)

After the polymerizable monomer composition obtained in "(1-1) Preparation process of polymerizable monomer composition" is dispersed in an aqueous dispersion medium containing a dispersion stabilizer followed by adding a polymerization initiator, droplets of the polymerizable monomer composition are formed. Thus, a suspension (polymerizable monomer composition dispersion liquid) is obtained.

In the obtained suspension, an inhibitor of small diameter microparticle production is preferably added to effectively inhibit production of small diameter microparticles as by-products upon polymerization of toners.

Herein, the "inhibitor of small diameter microparticle production" means a compound which traps a radical derived from a polymerizable monomer and/or polymerization initiator, which is normally desired not to be present in an aqueous dispersion medium (an aqueous phase) but is actually dissolved in the aqueous phase in the course of forming droplets of a polymerizable monomer composition, and thus has the effect to inhibit production of small diameter microparticles as by-products upon polymerization.

Examples of the inhibitor of small diameter microparticle production include: hydroxyhydroquinone, hydroquinone sulfonic acid, hydroquinone carboxylic acid, and the metallic salt thereof; caffeic acid, 3,4-dihydroxy benzoic acid, 3,4-dihydroxy benzene sulfonic acid, and the metallic salt thereof; and pyrogallol, 2,3-dihydroxy benzoic acid, 2,3-dihydroxy benzene sulfonic acid, 2,3-dihydroxy cinnamic acid, and the metallic salt thereof.

The method of forming droplets is not particularly limited. Dispersion treatment for forming the droplets may be performed, for example, by means of a device capable of strong stirring such as an in-line type emulsifying and dispersing machine (product name: EBARA MILDER; manufactured by Ebara Corporation), or a high-speed emulsification dispersing machine (product name: T. K. HOMOMIXER MARK II; manufactured by PRIMIX Corporation).

Upon forming the droplets, a dispersion stabilizer is preferably contained in the aqueous dispersion medium to control the particle diameter of colored resin particles and improve the circularity.

The aqueous dispersion medium may be water alone but any of water-soluble solvents such as lower alcohols and lower ketones is preferably used together.

Examples of the dispersion stabilizer include metallic compounds including sulfates such as barium sulfate and calcium sulfate; carbonates such as barium carbonate, calcium carbonate and magnesium carbonate; phosphates such as calcium phosphate; metallic oxides such as aluminum oxide and titanium oxide; and metallic hydroxides such as aluminum hydroxide, magnesium hydroxide and ferric hydroxide; and organic compounds including water-soluble polymers such as polyvinyl alcohol, methyl cellulose and gelatin; anionic surfactants, cationic surfactants, nonionic surfactants, and ampholytic surfactants. Among the above, metallic hydroxides are preferable, and magnesium hydroxide generally used in the range from pH7.5 to 11 is particularly preferable.

The added amount of the dispersion stabilizer is preferably in the range from 0.1 to 20 parts by weight, more preferably from 0.2 to 10 parts by weight, with respect to the monovinyl monomer of 100 parts by weight.

Examples of the polymerization initiator used for polymerizing the polymerizable monomer composition include inorganic persulfates such as potassium persulfate and ammonium persulfate; azo compounds such as 4,4'-azobis(4-cyanovaleric acid), 2,2'-azobis(2-methyl-N-(2-hydroxyethyl)propionamide, 2,2'-azobis(2-amidinopropane) dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylhexanoate, t-butylperoxypyvalate, diisopropylperoxydicarbonate, di-t-butylperoxyisophthalate and t-butylperoxyisobutyrate. Among the above, the organic peroxides are preferably used.

The polymerization initiator may be added after dispersing the polymerizable monomer composition to the aqueous dispersion medium containing the dispersion stabilizer and before forming the droplets, or may be directly added to the polymerizable monomer composition upon preparing the polymerizable monomer composition.

The added amount of the polymerization initiator is preferably in the range from 0.1 to 20 parts by weight, more preferably from 0.3 to 15 parts by weight, most preferably from 1.0 to 10 parts by weight, with respect to the monovinyl monomer of 100 parts by weight.

(1-3) Polymerization Process

The suspension (the aqueous dispersion medium containing droplets of the polymerizable monomer composition) obtained in "(1-2) Droplets forming process (suspension process of obtaining suspension)" is heated in the presence of the polymerization initiator to polymerize (suspension polymerization). Thereby, an aqueous dispersion liquid of colored resin particles can be obtained.

In this process, following the above "(1-2) Droplets forming process (suspension process of obtaining suspension)", the polymerization reaction may proceed while performing the dispersion treatment by agitation to perform polymerization in the state that the droplets of the polymerizable monomer composition are stably dispersed.

In the polymerization process, the polymerization temperature is preferably 50° C. or more, more preferably in the range from 60 to 98° C. The polymerization time is preferably in the range from 1 to 20 hours, more preferably from 2 to 15 hours.

A core-shell type (or "capsule type") colored resin particle, which can be obtained by using the colored resin particle obtained by the polymerization method as a core layer and forming a shell layer, a material of which is different from that of the core layer, around the core layer, may be formed.

The core-shell type colored resin particles can take a balance of lowering of fixing temperature, resistance to hot offset and prevention of agglomeration at storage of the toner by covering the core layer containing a substance having a low-softening point with a shell layer containing a substance having a higher softening point.

A method for producing the core-shell type colored resin particles mentioned above is not be particularly limited, and may be produced by any conventional method. The in situ polymerization method and the phase separation method are preferable from the viewpoint of production efficiency.

A method of producing the core-shell type colored resin particles according to the in situ polymerization method will be hereinafter described.

A polymerizable monomer (a polymerizable monomer for shell) for forming a shell layer and a polymerization initiator for shell are added to an aqueous dispersion medium to which the colored resin particles to be a core layer are dispersed followed by polymerization, thus, the core-shell type colored resin particles can be obtained.

As the polymerizable monomer for shell, the above described polymerizable monomers can be similarly used. Among the above, any of monomers which provide a polymer having "Tg" of more than 80° C. such as styrene or methyl methacrylate may be preferably used alone or in combination of two or more kinds.

Examples of the polymerization initiator for shell used for polymerization of the polymerizable monomer for shell include polymerization initiators including metal persulfates such as potassium persulfate and ammonium persulfate; and water-soluble azo compounds such as 2,2'-azobis(2-methyl-N-(2-hydroxyethyl)propionamide) and 2,2'-azobis(2-methyl-N-(1,1-bis(hydroxymethyl)2-hydroxy ethyl)propionamide).

The added amount of the polymerization initiator for shell is preferably in the range from 0.1 to 30 parts by weight, more preferably from 1 to 20 parts by weight, with respect to the polymerizable monomer for shell of 100 parts by weight.

The polymerization temperature of the shell layer is preferably 50° C. or more, more preferably in the range from 60 to 95° C. Also, the polymerization time of the shell layer is preferably in the range from 1 to 20 hours, more preferably from 2 to 15 hours.

In the aqueous dispersion liquid of the colored resin particles obtained in this process, an unnecessary dispersion stabilizer may remain. Thus, it is preferable that acid or alkali is added to the aqueous dispersion liquid of the colored resin particles in accordance with the kind of dispersion stabilizer being used, and the dispersion stabilizer is solubilized, removed and washed.

If the dispersion stabilizer being used is an acid-soluble inorganic compound, acid is added to the aqueous dispersion liquid of the colored resin particles. On the other hand, if the dispersion stabilizer being used is an alkali-soluble inorganic compound, alkali is added to the aqueous dispersion liquid of the colored resin particles.

If the acid-soluble inorganic compound is used as the dispersion stabilizer, it is preferable to control pH of the aqueous dispersion liquid of the colored resin particles to 6.5 or less by adding acid.

Examples of the acid to be added upon acid washing include inorganic acids such as sulfuric acid, hydrochloric acid and nitric acid, and organic acids such as formic acid and acetic acid. Among the above, sulfuric acid is particularly suitable for high removal efficiency and small impact on production facilities.

The glass-transition temperature (Tg, ° C.) of the colored resin particles to be obtained in this process is preferably in the range from 40 to 70° C., more preferably from 45 to 60° C., even more preferably from 50 to 55° C.

If the glass-transition temperature (Tg) of the colored resin particles is less than the above range, hot offset, in which a toner fuses on a fixing roller, may easily occur. On the other hand, if the glass-transition temperature (Tg) of the colored resin particles exceeds the above range, since the low-temperature fixability of the toner may decrease, the temperature of a fixing roller may need to be set to high temperature upon fixing against the requirement of reduction in consumption energy.

The concentration of solid content of the aqueous dispersion of colored resin particles obtained by this process is adjusted using ion-exchanged water to the range from 3 to 35 wt %, more preferably from 5 to 25 wt %, and even more preferably from 5 to 20 wt %.

If the concentration of solid content is less than the above range, the load per unit time of the separation-washing mechanism in the following "Process of obtaining wet cake" may decrease, and the efficiency of separation and washing may decrease. On the other hand, if the concentration of solid content exceeds the above range, uniform washing may be difficult in the separation-washing mechanism in the following "Process of obtaining wet cake".

(2) Process of Obtaining Wet Cake

In this process, a desired wet cake having low percentage of moisture content can be obtained by using a filter cloth continuous running type belt filter having a specific separation-washing mechanism and a specific pressure-ventilation mechanism as a belt filter.

Figure 2:
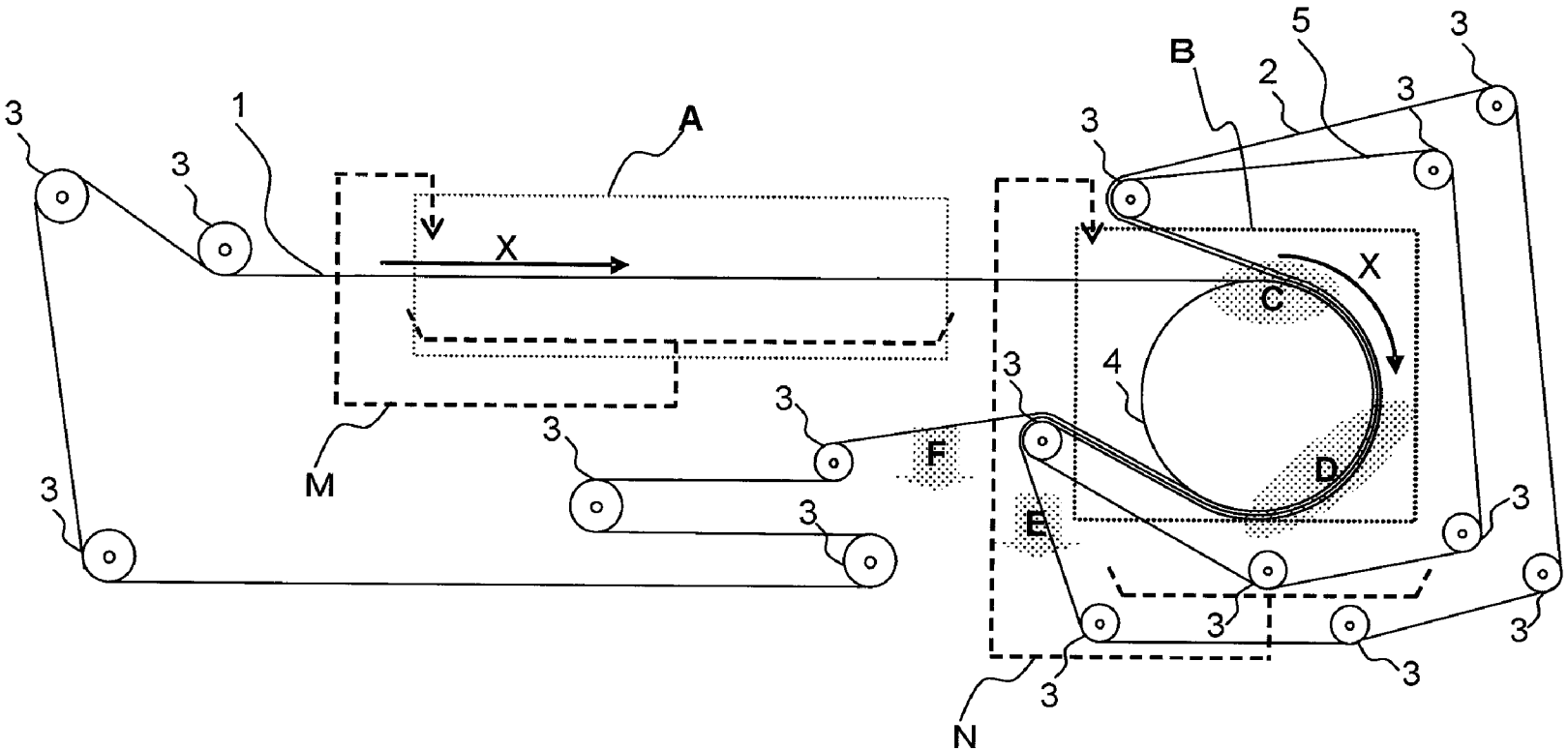
FIG. 2 is a schematic view of a filter cloth continuous running type belt filter of the present invention.

Each of FIG. 1 and FIG. 2 schematically shows an embodiment of a preferable filter cloth continuous running type belt filter of the present invention, but the present invention is not limited thereto.

Hereinafter, taking the filter cloth continuous running type belt filters shown in FIG. 1 and FIG. 2 as examples, the process will be explained.

In the present invention, "filter cloth continuous running type belt filter" means a vacuum-type belt filter comprising a separation-washing mechanism A, a pressure-ventilation mechanism B, and endless filter cloths (lower filter cloth 1 and upper filter cloth 2) which can be circularly driven continuously, wherein a vacuum tray (not shown) is disposed on the undersurface of the lower filter cloth 1 in the separation-washing mechanism A.

As shown in FIG. 1 and FIG. 2, the endless lower filter cloth 1 and the endless upper filter cloth 2 are stretched on plural rollers 3 and a press portion roller 4 in the state of tension, and continuously run in the direction of an arrow X by the rotation of the rollers. The press portion roller 4 is arranged in the pressure-ventilation mechanism B so that a wet cake is disposed between the upper and lower filter cloths and pressure can be applied thereto keeping the wet cake closely attached between the upper and lower filter cloths.

The ventilation degree of the endless lower filter cloth 1 is preferably in the range from 0.1 to 10 $cc/cm^2 \cdot sec.$, more preferably from 0.2 to 5 $cc/cm^2 \cdot sec.$, even more preferably from 0.3 to 2 $cc/cm^2 \cdot sec.$, and further more preferably from 0.4 to 0.8 $cc/cm^2 \cdot sec.$ If the ventilation degree of the lower filter cloth 1 is less than the above range, sufficient water permeability may not be obtained, and the percentage of moisture content may not be sufficiently decreased through the separation-washing mechanism and the pressure-ventilation mechanism. On the other hand, if the ventilation degree of the lower filter cloth 1 exceeds the above range, the solid content (the colored resin particles) may easily pass through the filter cloth so that the yield of the colored resin particles may decrease.

The ventilation degree of the endless upper filter cloth 2 is preferably in the range from 1 to 50 $cc/cm^2 \cdot sec$, more preferably from 1 to 30 $cc/cm^2 \cdot sec$, even more preferably from 1 to 10 $cc/cm^2 \cdot sec.$, and further more preferably from 1 to 3 $cc/cm^2 \cdot sec.$ If the ventilation degree of the upper filter cloth 2 is less than the above range, sufficient air permeability may not be obtained, and the percentage of moisture content may not be sufficiently decreased through the pressure-ventilation mechanism. On the other hand, if the ventilation degree of the upper filter cloth 2 exceeds the above range, the solid content (the colored resin particles) may easily pass through the filter cloth so that the yield of the colored resin particles may decrease.

The properties required for the endless lower filter cloth 1 and upper filter cloth 2 are capability of solid-liquid separation without leaking the solid content (colored resin particles) from the filter cloth, smaller possibility of meandering upon continuous running of the filter cloth, strain resistance to stretch of plural rollers, and excellent releasing characteristic from the filter cloth and yield of the wet cake formed on the filter cloth.

The lower filter cloth 1 and the upper filter cloth 2 respectively are required to have strain resistance (tensile strength) in the vertical direction (the running direction of filter cloth) and in the horizontal direction (the width direction of filter cloth) since the lower filter cloth 1 and the upper filter cloth 2 continuously run while the filter cloths are stretched in the state that the wet cake is disposed between the upper and lower filter cloths.

The tensile strength of the lower filter cloth 1 and the upper filter cloth 2 respectively are preferably 150 to 1,200 N/cm, more preferably 300 to 1,200 N/cm, and even more preferably 600 to 1,200 N/cm, in the running direction of filter cloth and in the width direction of filter cloth.

If each of the tensile strength of the lower filter cloth 1 and the upper filter cloth 2 is lower than the above range, the filter cloth may be easily damaged during continuous running, and the yield of the colored resin particles may be decreased. On the other hand, if each of the tensile strength of the lower filter cloth 1 and the upper filter cloth 2 exceeds the above range, it may be difficult to suitably mount the filter cloth on each roller of the filter cloth intermittent motion type belt filter, and defects of the traveling performance of the filter cloth may occur.

The material of the endless lower filter cloth 1 and upper filter cloth 2 is not particularly limited. Nonwoven cloth is preferably employed since a desired ventilation degree and tensile strength can be obtained, the solid content (colored resin particles) hardly goes through the filter cloth, and colored resin particles can be suitably separated (captured), and a wet cake (colored resin particles in wet state) having a low percentage of moisture content can be obtained at high yield.

Herein, "nonwoven cloth" means a cloth in a form of sheet or plate obtained by stacking webs having original threads (fiber) randomly arranged followed by twisting together and bonding the stacked webs.

A method of producing the nonwoven cloth is not particularly limited, and various known production methods may be used. Examples of methods of forming a web include the dry method, in which a web is formed by disposing short fiber in one direction by a carding machine, the wet method, in which short fiber is made like paper using water, and the spunbond method, in which a web is formed using endless long fiber.

Examples of methods of bonding fibers each other include the thermal bond method, in which fiber having a low melting point is pressed with a heat roller, the chemical bond method, in which fibers are bonded using an adhesive resin, the needle punch method, in which fibers are twisted each other by a minute protrusion of a needle, the stitch bond method, in which fibers are set in by a thread, and the span lace method, in which fibers are twisted by high pressure water flow.

The nonwoven cloth used as material of the lower filter cloth 1 and upper filter cloth 2 is preferably subjected to surface treatment to flatten the surface of the filter cloth since releasing characteristic from the filter cloth and yield of the wet cake formed on the filter cloth can be improved.

Specifically, the examples include a method comprising the steps of sandwiching a web being an interim product of nonwoven cloth from the top and bottom, punching it with needles, and subjecting the surface of the nonwoven cloth to heat treatment, and a method comprising the steps of letting a nonwoven cloth through two rollers heated and pressurized to melt the surface of the nonwoven cloth.

In the present invention, as the material of the lower filter cloth 1 and upper filter cloth 2, nonwoven cloth is preferably employed, but woven cloth may also be employed. Generally, woven cloth is constituted with original yarn.

Original yarn of woven cloth is constituted with bound several to several tens of original fiber or one ply of them. Woven cloth is constituted by perpendicularly crossing original yarn as warp and weft according to a certain regulation, and forming a plurality of weave texture (crossing of the warp and weft). The obtained woven cloth has a continuous constitution in which pitch (a distance between warps and a distance between wefts) of the weave texture is constant.

In the constitution of woven cloth, avoid exists between weave texture and weave texture. The void passes completely through from the surface of the woven cloth to the back side of the woven cloth.

The ventilation degree of general woven cloth is adjusted by the density of fiber (the number of fibers and the amount of voids existing between fibers) and the density of weave texture (the number of weave texture and the amount of voids existing between weave textures).

That is, if the pitch (the distance between warps and/or the distance between wefts) is increased to increase the ventilation degree in order to increase the filtration rate, the colored resin particles may go through (leak). On the other hand, if the pitch (the distance between warps and/or the distance between wefts) is decreased in order to prevent the colored resin particles from going through (leak), the ventilation degree may decrease, clogging may occur, and the filtration rate may decrease.

To the contrary, nonwoven cloth simultaneously has contracting characteristics in woven cloth, wherein the surface and back side of nonwoven cloth have a significantly precise mesh structure compared to those of woven cloth due to twisting of fibers, and the number and amount of voids exceed those of woven cloth due to layered fibers. Thus, by using nonwoven cloth, the solid content (colored resin particles) cannot easily go through the filter cloth, the colored resin particles can be suitably separated (captured), and a wet cake (colored resin particle in wet state) having a low percentage of moisture content can be obtained at high yield.

Also, since nonwoven cloth has high water-holding property, releasing characteristic of the wet cake (colored resin particle in wet state) is excellent, and a wet cake (colored resin particle in wet state) having a low percentage of moisture content can be obtained at high yield. This characteristic of nonwoven cloth tends to be more noticeable if the particle diameter is small and dewaterability is inferior.

Generally, fiber constituting nonwoven cloth can be classified into natural fiber and chemical fiber.

Further, the natural fiber can be classified into three kinds including vegetable matter (cotton and hemp), animal matter (wool and silk) and mineral matter (asbestos). The chemical fiber can be classified into four kinds including recycled fiber, semi-synthetic fiber, synthetic fiber and inorganic fiber.

In the present invention, fiber constituting nonwoven cloth is not particularly limited, but synthetic fiber is preferably used since a desired ventilation degree and tensile strength can be obtained, the solid content (colored resin particles) hardly goes through the filter cloth, colored resin particles can be suitably separated (captured), and a wet cake (colored resin particles in wet state) having a low percentage of moisture content can be obtained at high yield.

Examples of the synthetic fiber include fibers constituted with polypropylene, polyester, polyethylene, polyamide, polyurethane, polyolefin, polyvinyl chloride, polyvinylidene chloride, polyfluoroethylene, polyacrylic acid and polyvinyl alcohol.

The nonwoven cloth may be synthetic fiber made of one kind of fiber, or synthetic fiber made of two or more kinds of fiber (mixed fiber).

Also, the structure of the nonwoven cloth may be a single-layer structure, but is preferably a multi-layer structure.

As the structure of the nonwoven cloth, a three-layer structure is more preferably employed. Specifically, nonwoven cloth having a structure of three layers constituting a center foundation cloth disposed between synthetic fibers.

Examples of nonwoven cloth preferably used in the present invention include nonwoven cloth having a single-layer structure made of polypropylene fiber, nonwoven cloth having a single-layer structure made of polyester fiber, nonwoven cloth having a structure of three layers constituted with a center foundation cloth of polypropylene fiber disposed between polypropylene fibers, and nonwoven cloth having a structure of three layers constituted with a center foundation cloth of polyester fiber disposed between mixed fibers of polypropylene and polyethylene.

The press portion roller 4 is equipped with a ventilation means capable of supplying gas used for ventilation.

The ventilation means is not particularly limited. The examples include a means in which circular ventilation holes are provided on the surface of the press portion roller 4.

Specifically, in the pressure-ventilation mechanism B of FIG. 1, the gas which comes out from ventilation holes reaches the wet cake disposed between the upper and lower filter cloths through the upper filter cloth 2, the wet cake is ventilated, and the filtrate is discharged through the lower filter cloth 1. Thereby, the percentage of moisture content of the wet cake is decreased.

Since it is required for the lower filter cloth 1 used in FIG. 1 that the solid content (colored resin particles) easily goes through the filter cloth and the filtration performance is excellent with high water permeability in both separation-washing mechanism A and pressure-ventilation mechanism B, it is necessary to select the lower filter cloth 1 mainly taking the filtration performance into consideration.

Since it is required for the upper filter cloth 2 used in FIG. 1 that the filtration performance is excellent so that air sufficiently reaches the wet cake disposed between the upper and lower filter cloths in the pressure-ventilation mechanism B, it is necessary to select the upper filter cloth 2 mainly taking the filtration performance into consideration.

To the contrary, in the pressure-ventilation mechanism B of FIG. 2, the air discharged from the ventilation holes reaches the wet cake disposed between the upper and lower filter cloths through the lower filter cloth, the wet cake is ventilated, and the filtrate is discharged through the upper filter cloth 2 and then through the seal belt 5. Thereby, the percentage of moisture content of the wet cake is decreased.

Since it is required for the lower filter cloth 1 used in FIG. 2 that the solid content (colored resin particles) easily goes through the filter cloth and the filtration performance is excellent with high water permeability in the separation-washing mechanism A while it is required for the lower filter cloth 1 used in FIG. 2 that the filtration performance is excellent so that air sufficiently reaches the wet cake disposed between the upper and lower filter cloths in the pressure-ventilation mechanism B, it is necessary to select the lower filter cloth 1 mainly taking the filtration performance and ventilation performance into consideration.

Since it is required for the upper filter cloth 2 used in FIG. 2 that the solid content (colored resin particles) easily goes through the filter cloth and the filtration performance is excellent with high water permeability in the pressure-ventilation mechanism B, it is necessary to select the upper filter cloth 2 mainly taking the filtration performance into consideration.

If the upper filter cloth 2 for FIG. 2 is selected mainly taking the filtration performance into consideration, the upper filter cloth 2 has relatively low ventilation degree, thus, the stretched upper filter cloth 2 may uplift and the wet cake may be fluidized depending on the strength of the pressure of gas blown out from the ventilation holes. Thus, from the viewpoint of preventing the upper filter cloth 2 from uplifting, it is preferable to provide the seal belt 5.

The seal belt 5 shown in FIG. 2 is not particularly limited if it can prevent the upper filter cloth 2 from uplifting and has a structure that can further let through the filtrate discharged through the upper filter cloth 2. For example, a sheet-like belt made of metal or resin having a plurality of ventilation holes can be used.

The total area of the ventilation holes provided to the press portion roller 4 is preferably in the range from 20 to 70%, more preferably from 30 to 65%, with respect to the total surface area of the press portion roller 4 before provided with the ventilation holes of 100%, from the viewpoint of obtaining a desired ventilation amount taking the strength of the filter cloths used in the pressure-ventilation mechanism into account.

(2-1) Separation-Washing Mechanism

In this mechanism, the aqueous dispersion of the colored resin particles is always uniformly supplied on the upper surface of the endless lower filter cloth 1 running in a horizontal direction, and colored resin particles are continuously separated (captured) followed by washing treatment performed by adding water and continuous suction-dehydrating treatment performed by the decompression action of a vacuum tray (not shown) disposed on the undersurface of the lower filter cloth 1. Thus, a wet cake is formed.

The percentage of moisture content of the wet cake formed by the separation-washing mechanism is preferably 45 wt % or less, more preferably 40 wt % or less, and even more preferably 35 wt % or less. If the percentage of moisture content is 45 wt % or less, it is possible to prevent flow out of the fluidized wet cake from the filter cloths when the wet cake is disposed between two (upper and lower) filter cloths in the pressure-ventilation mechanism.

If a wet cake, having the percentage of moisture content exceeding 45 wt % as it is, is conveyed to the specific pressure-ventilation mechanism, there is a problem that the wet cake disposed between the upper and lower filter cloths may leak from the edge of the filter cloths since the wet cake easily fluidizes.

Also, it is inferior for productivity to decrease the percentage of moisture content of the wet cake to less than 25 wt % since the operating time is long.

From the above perception, in the present invention, a preferable percentage of moisture content of the wet cake before being conveyed into the specific pressure-ventilation mechanism is defined in the range from 25 to 45 wt %.

The percentage of moisture content of the wet cake formed by the separation-washing mechanism is preferably in the range from 25 to 45 wt %, more preferably from 25 to 40 wt %.

If the percentage of moisture content of the wet cake is less than the above range, the effect of sealing both edges of the wet cake may not be sufficiently obtained when the wet cake is disposed between upper and lower filter cloths in the following pressure-ventilation mechanism. On the other hand, if the percentage of moisture content of the wet cake exceeds the above range, the amount of moisture may exceeds, and therefore, the state that the wet cake is disposed between upper and lower filter cloths cannot be maintained in the following pressure-ventilation mechanism so that the wet cake may fluidize and leak from the edge of the filter cloth.

In the present invention, the amount of solid content (the amount of colored resin particles) in a filtrate discharged through the lower or upper filter cloth is preferably 1% or less, more preferably 0.3% or less, and even more preferably 500 ppm or less.

If the amount of solid content (the amount of colored resin particles) in the filtrate exceeds the above range, the solid content (colored resin particles) easily goes through the lower or upper filter cloth so that the filtration performance of the lower or upper filter cloth may be inferior and the yield of the colored resin particles may decrease.

If the amount of solid content (the amount of colored resin particles) in the filtrate exceeds the above range, the yield of the colored resin particles can be improved by providing a filtrate collecting-supplying mechanisms M and N (shown in FIG. 2) capable of collecting the filtrate discharged through the lower or upper filter cloth and supplying the filtrate again to the upper surface of the endless lower filter cloth 1 running in the horizontal direction.

Similarly as FIG. 2, the filtrate collecting-supplying mechanisms M and N can be provided in FIG. 1. Thereby, a similar effect can be obtained as FIG. 2.

Herein, "the amount of solid content in the filtrate" means a value obtained by collecting all filtrate discharged through the separation-washing mechanism A or the pressure-ventilation mechanism B, sampling a predetermined amount (g) of the filtrate from all the collected filtrate, filtering the filtrate using a filter paper, drying a residue collected on the filter paper, measuring the weight (g) of the collected residue, and calculating the amount (%) of the solid content in the filtrate by the following Calculation formula 1:

Amount of solid content in filtrate (%)=[weight of collected residue (g)/amount of filtrate (g)]×100 Calculation formula 1:

As the filter paper used for collecting the residue, various commercial products having a collecting efficiency in accordance with JIS Z 8901: 2006 (Test powders and test particles) of preferably 70 to 98%, more preferably 80 to 95%, and a holding particle size of preferably 10 μm or less, more preferably 5 μm or less, even more preferably 3 μm or less, may be used.

Examples of the filter paper include commercial products manufactured by Toyo Roshi Kaisha, Ltd. such as No. 3 (product name; holding particle size: 5 μm; collecting efficiency (0.3 μm DOP %): 80%), No. 5A (product name; holding particle size: 7 μm; collecting efficiency (0.3 μm DOP %): 75%), No. 5B (product name; holding particle size: 4 μm; collecting efficiency (0.3 μm DOP %): 90%), No. 5C (product name; holding particle size: 1 μm; collecting efficiency (0.3 μm DOP %): 93%), No. 6 (product name; holding particle size: 3 μm; collecting efficiency (0.3 μm DOP %): 90%), No. 7 (product name; holding particle size: 4 μm; collecting efficiency (0.3 μm DOP %): 85%), and No. 4A (product name; holding particle size: 1 μm; collecting efficiency (0.3 μm DOP %): 90%). Among the above commercial products, No. 5C (product name; holding particle size: 1 μm; collecting efficiency (0.3 μm DOP %): 93%) is preferably used.

Herein, "the collecting efficiency of the filter paper" means the rate of dioctyl phthalate (DOP) particles having a particle diameter of 0.3 μm (0.3 μm DOP %) captured on a filter paper when air (aerosol) containing dioctyl phthalate particles having a particle diameter of 0.3 μm is generated by means of a mist form generator under pressure, and the aerosol is passed though the filter paper at the ventilation rate of 1 m/min.

"Holding particle size" is determined from the leakage particle diameter when a suspected liquid such as barium sulfate defined by JIS P3801:1995 (Filter paper (for chemical analysis)) is naturally filtered using a filter paper.

The average thickness X of the wet cake formed by the separation-washing mechanism is preferably in the range from 1 to 30 mm, more preferably from 1 to 20 mm, and even more preferably from 3 to 20 mm.

If the average thickness X of the wet cake is less than the above range, not only productivity of the toner may decrease but also it may be difficult to peel the wet cake having low percentage of moisture content. On the other hand, if the average thickness X of the wet cake exceeds the above range, it may be difficult to dispose the wet cake between two (upper and lower) filter cloths, and air leak upon ventilation may occur.

(2-2) Pressure-Ventilation Mechanism

In this mechanism, the wet cake formed on the upper surface of the endless lower filter cloth 1 in the separation-washing mechanism A is continuously conveyed, and the wet cake is covered with the endless upper filter cloth 2. Then, the wet cake, disposed between the upper and lower filter cloths, is conveyed to the pressure-ventilation mechanism B, and the wet cake is ventilated while pressure is applied to the wet cake. Thus, a wet cake having low percentage of moisture content can be obtained.

The wet cake formed on the upper surface of the lower filter cloth 1 is set between the upper and lower filter cloths on the roller 3 having the largest diameter among a plurality of rollers 3 in FIG. 1. The ventilation of the wet cake disposed between the upper and lower filter cloths is performed on the press portion roller 4 while pressing, and the filtrate is discharged through the lower filter cloth 1. Thereby, a wet cake having a low percentage of moisture content can be obtained.

To the contrary, in FIG. 2, the wet cake formed on the upper surface of the lower filter cloth 1 is set between the upper and lower filter cloths on the press portion roller 4 (shown as "wet cake set region C"). The ventilation of the wet cake disposed between the upper and lower filter cloths is performed on the press portion roller 4 while pressing, and the filtrate is discharged through the upper filter cloth 2 (shown as "ventilation-filtrate discharge region D"). Thereby, a wet cake having a low percentage of moisture content can be obtained.

That is, since in FIG. 2, "the wet cake can be set between the upper and lower filter cloths" and "the wet cake can be ventilated" on one press portion roller 4 without providing roller 3 having particularly large diameter in the device besides the press portion roller 4 as in FIG. 1, more compact filter cloth intermittent motion type belt filter can be designed than that of FIG. 1.

The "ventilation-filtrate discharge region D" in FIG. 2 schematically shows a region wherein the ventilation is performed with pressure and the filtrate is discharged through the upper filter cloth 2, and the region is not limited thereto.

The pressure on the pressurizing surface of the press portion roller 4 generated by the tension of the filter cloth is preferably in the range from 0.2 to 1.5 MPa, more preferably from 0.3 to 1.0 MPa, even more preferably from 0.3 to 0.8 MPa.

If the pressure on the pressurizing surface is less than the above range, the pressure on the pressurizing surface may be so low that sealing of the wet cake may be insufficient, and the percentage of moisture content of the wet cake may not be decreased sufficiently. Also, upon applying pressure and ventilating at the same time, the state of wet cake disposed between the upper and lower filter cloths cannot be maintained and fluidized wet cake may leak from the edges of the filter cloth. On the other hand, if the pressure on the pressurizing surface exceeds the above range, the pressure on the pressurizing surface may be so high that the particle size characteristics of the colored resin particles may be adversely affected.

In the present invention, the area to ventilate the wet cake conveyed to the pressure-ventilation mechanism B is preferably the area excluding 15 mm or more from both edges of the wet cake in the width direction.

The percentage of moisture content decreases due to both pressurization action and ventilation action in the area excluding both edges of the wet cake in the width direction (center area), while both edges of the wet cake in the width direction are not subjected to ventilation, thus, the percentage of moisture content decreases only due to the pressurization action.

Hence, both edges of the wet cake in the width direction have higher the percentage of moisture content than the center area as they are not subjected to the ventilation action.

That is, both edges of the wet cake have more moistness than the center area.

The inventors of the present invention have found out that this moistness causes the effect of sealing both edges of the wet cake when the wet cake is disposed between upper and lower filter cloths.

By the effect of sealing both edges of the wet cake, leak of wet cake can be prevented when pressure is applied and also air leak can be prevented upon ventilation.

In the present invention, specific embodiments of "the wet cake, disposed between the upper and lower filter cloths, is ventilated while pressure is applied to the wet cake" include the embodiment in which the wet cake is ventilated while pressure of the level not changing the volume of the wet cake is applied, the embodiment in which the wet cake is ventilated while pressure of the level changing the volume of the wet cake is applied, and so on.

In the present invention, pressure is applied simultaneously while the wet cake is ventilated in order to accelerate the reduction of the percentage of moisture content of the wet cake. As gas used for ventilation, compressed air is preferably used since the effect of accelerating the reduction of the percentage of moisture content is high.

The pressure (ventilation pressure) Z of gas used for ventilation is preferably in the range from 0.2 to 1.5 MPa, more preferably from 0.25 to 0.9 MPa, even more preferably from 0.3 to 0.7 MPa.

If the pressure of gas used for ventilation is less than the above range, ventilation toward the wet cake may not be sufficient, and thus, the effect of accelerating the reduction of the percentage of moisture content may not be sufficiently obtained. On the other hand, if the pressure of gas used for ventilation exceeds the above range, ventilation toward the wet cake may be too much, and thus, the particle size characteristics of the colored resin particles may be adversely affected.

Further, ventilation is preferably performed at the pressure Z (ventilation pressure) of gas used for ventilation of 0.2 to 1.5 MPa for 10 to 150 seconds, more preferably at 0.25 to 0.9 MPa for 10 to 100 seconds, and even more preferably at 0.3 to 0.9 MPa for 10 to 100 seconds.

If the ventilation pressure and the ventilation time lower the above range, the reduction of the percentage of moisture content by the ventilation action may not efficiently proceed, and the ventilation time to reduce the percentage of moisture content may be long. On the other hand, if the ventilation pressure and the ventilation time exceed the above range, impact of ventilation on the wet cake is so high that the wet cake may lose shape, and the effect of accelerating the reduction of the percentage of moisture content may not be sufficiently obtained.

As described above, the distance Y from each edge of the wet cake not subjected to ventilation is preferably set to 15 mm or more, more preferably 20 mm or more, and even more preferably 30 mm or more. The distance Y from each edge of the wet cake may be appropriately set according to the average thickness X and ventilation pressure Z of the wet cake obtained by the separation-washing mechanism. It is preferable to increase this distance since the toner is less likely to leak from the filter cloths even if the average thickness X of the wet cake increases.

If the average thickness X of the wet cake is less than 10 mm, it is preferable to set the distance Y from each edge of the wet cake not subjected to ventilation to 18 mm or more, more preferably 20 mm or more, and the ventilation pressure Z to the range from 0.25 to 0.5 MPa.

On the other hand, if the average thickness X of the wet cake is in the range from 10 to 30 mm, the distance Y from each edge of the wet cake not subjected to ventilation and the average thickness X of the wet cake are preferably set to satisfy the relationship of "$Y \geqq X+10$ mm".

Also, the ventilation pressure Z and the average thickness X of the wet cake are preferably set to satisfy the relationship of "$Z \geqq 0.5+(X-10)/30$ mm".

In the present invention, in order to accelerate the reduction of the percentage of moisture content of the wet cake, it is preferable to heat gas used for ventilation.

The temperature of gas used for ventilation is preferably set taking the glass-transition temperature (Tg) of the colored resin particles so that troubles such as fusion between colored resin particles through the pressure-ventilation mechanism can be prevented.

Specifically, the temperature $T_1$ (° C.) of gas used for ventilation is preferably set to satisfy the relationship of "$Tg-35° C. < T_1 < Tg+20° C.$", more preferably "$Tg-30° C. < T_1 < Tg+10° C.$", and even more preferably "$Tg-20° C. < T_1 < Tg$".

If the temperature $T_1$ of gas used for ventilation does not satisfy the above relationship, the temperature $T_1$ of gas used for ventilation may be so low that the effect of accelerating the reduction of the percentage of moisture content may not be sufficiently obtained, or the temperature $T_1$ of gas used for ventilation may be so high that fusion between colored resin particles may easily occur and the particle size characteristics of the colored resin particles may be adversely affected.

The percentage of moisture content of a part about 1 cm from the edge of the wet cake obtained from the pressure-ventilation mechanism is preferably in the range from 15 to 45 wt %, more preferably from 15 to 40 wt %.

If the percentage of moisture content of the wet cake is less than the above range, the effect of sealing both edges of the wet cake may not be sufficiently obtained. On the other hand, the percentage of moisture content of the wet cake exceeds the above range, leak of the wet cake may not be able to be prevented when pressure is applied, and air leak may not be prevented upon ventilation.

The percentage of moisture content of the center area of the wet cake obtained from the pressure-ventilation mechanism is preferably in the range from 3 to 15 wt %, more preferably from 3 to 12 wt %.

If the percentage of moisture content of the wet cake is less than the above range, powder may spread. On the other hand, if the percentage of moisture content of the wet cake exceeds the above range, the time for drying may be long.

The average percentage of moisture content of the wet cake obtained by the pressure-ventilation mechanism is preferably 20 wt % or less, more preferably 18 wt % or less, even more preferably 16 wt % or less, and most preferably 12 wt % or less.

If the average percentage of moisture content of the wet cake exceeds the above range, the workload in the following "Process of drying wet cake" may not be reduced, and the productivity of a toner may be inferior.

Herein, "average percentage of moisture content" means the percentage of moisture content determined after sampling about 1 cm width across the wet cake and mixing the sampled wet cake uniformly.

It is schematically shown in the filter cloth intermittent motion type belt filter of FIG. 2 that the wet cake formed on the upper surface of the upper filter cloth 2 is mainly collected at the collecting region E of the wet cake, and the wet cake formed on the upper surface of the lower filter cloth 1 is mainly collected at the collecting region F of the wet cake.

The electrical conductivity of the filtrate, obtained by preparing a dispersion liquid of the wet cake obtained by the pressure-ventilation process so that the concentration of solid content is 20 wt %, and filtering the dispersion liquid, is preferably in the range from 0.5 to 20 μS/cm, more preferably from 0.5 to 15 μS/cm.

Generally, the electrical conductivity of a filtrate is used as an index for determining the level of cleaning degree of colored resin particles.

The electrical conductivity can be measured by, for example, a conductance meter (product name: ES-12) manufactured by HORIBA, Ltd.

If the electrical conductivity of the filtrate exceeds the above range, the cleaning degree of the colored resin particles may be low, the toner produced therefrom may have high moisture absorptivity and may not be able to suitably exhibit charging characteristics, deterioration of image quality due to fog or the like may easily occur, and printing performance may be adversely affected.

Hence, if the electrical conductivity of the filtrate exceeds the above range, the cleaning degree of the colored resin particles needs to be increased.

(3) Process of Drying Wet Cake

Since the wet cake having low percentage of moisture content can be obtained in the above "(2-2) Pressure-ventilation mechanism", the workload in the drying process can be reduced. Therefore, in this process, colored resin particles excellent in productivity can be obtained.

A method of drying the wet cake having low percentage of moisture content obtained by the above "(2-2) Pressure-ventilation mechanism" is not particularly limited, and any of various known methods can be used. The examples include the vacuum drying, the flash drying, drying with a spray dryer and the fluid bed drying method.

The dryer is not particularly limited if it is a dryer which can obtain desired dried colored resin particles. Various commercial dryers can be used. The representative examples include dryers utilizing the vacuum drying such as a vacuum dryer (product name: Nauta mixer NXV-1) manufactured by HOSOKAWAMICRON CORPORATION, a vacuum dryer (product name: Ribocone) manufactured by OKAWARA MFG. CO., LTD., and a vacuum dryer (product name: SV MIXER) manufactured by KOBELCO ECO-SOLUTIONS Co., Ltd.; dryers utilizing the flash drying such as a flash dryer (product name: Drymeister DMR) manufactured by HOSOKAWAMICRON CORPORATION, and a flash dryer (product name: flash jet dryer) manufactured by Seishin Enterprises Co., Ltd.; and dryers utilizing the fluid bed drying method such as a fluid bed dryer (product name: Slit flow) manufactured by OKAWARA MFG. CO., LTD.

(Colored Resin Particles)

Hereinafter, the particle size characteristics of colored resin particles obtained by the above "(3) Process of drying wet cake" will be described.

Colored resin particles hereinafter described includes both core-shell type colored resin particles and colored resin particles which are not core-shell type.

The volume average particle diameter (Dv) of the colored resin particles is preferably in the range from 5 to 15 μm, more preferably from 6 to 12 μm, and even more preferably from 7 to 10 μm, from the viewpoint of forming images having high image quality.

If "Dv" of the colored resin particles is less than the above range, the flowability of the toner lowers, and deterioration of image quality due to fog or the like tends to occur, so that printing performance may be adversely affected. On the other hand, if "Dv" of the colored resin particles exceeds the above range, it may be difficult to form highly precise images, and the resolution of images to be obtained may decrease, so that printing performance may be adversely affected.

The particle size distribution (Dv/Dn), which is the ratio of a volume average particle diameter (Dv) and a number average particle diameter (Dn) of the colored resin particles, is preferably in the range from 1.0 to 1.3, more preferably from 1.0 to 1.2, from the viewpoint of forming highly precise images.

If the particle size distribution (Dv/Dn) of the colored resin particles exceeds the above range, the flowability of the toner lowers and deterioration of image quality due to fog or the like tends to occur so that printing performance may be adversely affected.

"Dv" and "Dn" of the colored resin particles are values measured by a particle diameter measuring device and may be measured, for example, by means of a particle diameter measuring device (product name: MULTISIZER; manufactured by Beckman Coulter, Inc.).

The average circularity of the colored resin particles is preferably in the range from 0.96 to 1.00, more preferably from 0.97 to 1.00, and even more preferably from 0.98 to 1.00, from the viewpoint of forming highly precise images.

If the average circularity of the colored resin particles is less than the above range, the reproducibility of thin lines of toner printing may easily decrease so that printing performance may be adversely affected.

Herein, "circularity" is a value obtained by dividing a perimeter of a circle having an area same as a projected area of a particle by a perimeter of a particle image. Also, in the present invention, an average circularity is used as a simple method of quantitatively presenting shapes of particles and is an indicator showing the level of convexo-concave shapes of the colored resin particle. The average circularity is "1" when the colored resin particle is an absolute sphere, and becomes smaller as the shape of the surface of the colored resin particle becomes more complex. In order to obtain the average circularity (Ca), firstly, the circularity (Ci) of each of measured "n" particles of 0.4 μm or more by the diameter of an equivalent circle is calculated by the following Calculation formula 2. Next, the average circularity (Ca) is obtained by the following Calculation formula 3.

Circularity (Ci)=a perimeter of a circle having an area same as a projected area of a particle/a perimeter of a particle image Calculation formula 2:

Calculation formula 3

$$Ca = \frac{\sum_{i=1}^{n} (Ci \times fi)}{\sum_{i=1}^{n} (fi)}$$

In Calculation formula 3, "fi" is the frequency of particles of circularity (Ci).

The above circularity and average circularity may be measured by means of any of flow-type particle image analyzers FPIA-2000, FPIA-2100, FPIA-3000 (product names; manufactured by Sysmex Co.) or the like.

(4) External Addition Process

In the method for producing a toner of the present invention, the colored resin particles obtained by the above "(3) Process of drying wet cake" may be a toner as it is. Also, the colored resin particles obtained by the above "(3) Process of drying wet cake" may be subjected to external addition treatment including mixing with an external additive, agitating and attaching the external additive on the surface of the colored resin particles to form a one-component toner from the viewpoint of controlling charge property, flowability, shelf stability and so on of the toner.

Further, in addition to the one-component toner, carrier particles may be mixed and agitated to form a two-component developer.

An agitator for external addition treatment is not particularly limited if one can attach an external additive on the surface of the colored resin particles. The external addition treatment may be performed using a device capable of mixing and agitating including, for example, FM MIXER (product name, manufactured by NIPPON COKE & ENGINEERING CO., LTD.), SUPER MIXER (product name, manufactured by KAWATA MFG Co., Ltd.), Q MIXER (product name, manufactured by NIPPON COKE & ENGINEERING CO., LTD.), Mechanofusion system (product name, manufactured by Hosokawa Micron Corporation) and MECHANOMILL (product name, manufactured by OKADA SEIKO CO., LTD.).

Examples of the external additive include inorganic microparticles such as silica, titanium oxides, aluminum oxides, zinc oxides, tin oxides, calcium carbonates, calcium phosphates, and cerium oxides; and organic microparticles such as polymethylmethacrylate resins, silicone resins, and melamine resins. Among the above, the inorganic microparticles are preferable, silica and titanium oxides are more preferable, and silica is even more preferable.

These external additives may be preferably used alone or in combination of two or more kinds.

In the present invention, the external additive is generally used in the rage from 0.05 to 6 parts by weights, preferably from 0.2 to 5 parts by weight, with respect to the colored resin particles of 100 parts by weight.

(Toner)

The method for producing the toner comprising the steps of (1) to (4) uses, in "(2) Process of obtaining wet cake", the filter cloth continuous running type belt filter having the specific separation-washing mechanism, and the specific pressure-ventilation mechanism as described above as a belt filter, therefore, the percentage of moisture content of the wet cake can be sufficiently reduced, the workload in the following "(3) Process of drying wet cake" can be reduced, and productivity of the toner is excellent.

EXAMPLES

Hereinafter, the present invention will be explained further in detail with reference to examples and comparative examples. However, the scope of the present invention may not be limited to the following examples. Herein, "part(s)" and "%" are based on weight if not particularly mentioned.

Test methods used in the examples and the comparative examples are as follows.

(Test Methods)

(1) Glass-Transition Temperature (Tg) of Colored Resin Particles

A part of the aqueous dispersion of colored resin particles obtained by "(1) Process of obtaining aqueous dispersion of colored resin particles" was sampled and dried. The dried testing sample (colored resin particles) was precisely weighed by about 10 mg. The precisely weighed testing sample was charged in an aluminium pan, and the glass-transition temperature (Tg) of colored resin particles was measured by means of a differential scanning calorimetry (product name: DSC6220; manufactured by SII Nano Technology Inc.) in accordance with ASTMD3418-97 using an empty aluminium pan as a reference under the conditions of testing temperature in the range from 0 to 150° C. and heating rate of 10° C./min.

(2) Percentage of Moisture Content of Wet Cake (2-1) Wet Cake Formed by Separation-Washing Mechanism About 1 g of the wet cake formed by the separation-washing mechanism was weighed as a sample and placed on an aluminium pan. The weight ($W_1$ (g)) was precisely weighed down to 0.1 mg.

Next, the precisely weighed sample was left in a dryer set at 105° C. for 1 hour. After cooling, the weight ($W_2$ (g)) was precisely weighed, and the percentage of moisture content (%) was calculated by the following Calculation formula 4:

$$\text{Percentage of moisture content (\%)} = \frac{W_1 - W_2}{W_1} \times 100 \quad \text{Calculation formula 4}$$

(2-2) Wet Cake Obtained by Pressure-Ventilation Mechanism

About 1 g of about 1 cm from the edge of the wet cake obtained by the pressure-ventilation mechanism was weighed, and the percentage of moisture content (%) was calculated in a similar method as the above (2-1).

Also, about 1 g of the center part of the wet cake obtained by the pressure-ventilation mechanism was weighed as a sample, and the percentage of moisture content (%) was calculated in a similar method as the above (2-1).

Also, about 1 cm width across the wet cake obtained by the pressure-ventilation mechanism was sampled, and the sampled wet cake was mixed uniformly. Then, about 1 g was weighed as a sample, and the average percentage of moisture content (%) was calculated in a similar method as the above (2-1).

(3) Average Thickness X of Wet Cake

Both edges of the wet cake formed by the separation-washing mechanism were cut by 2 cm width, and 5 cm width across the wet cake was sampled carefully not to lose shape. Then, the thickness of the wet cake was measured at five points laterally at regular intervals using a thickness measuring gage. The average thickness X (mm) of the wet cake was calculated from the measured values of five points.

(4) Measurement of Electrical Conductivity

A part of the wet cake obtained by the pressure-ventilation mechanism was sampled, and dispersed in ion-exchanged water (electrical conductivity: 0.5 μS/cm) so that the concentration of solid content of the wet cake was 20 wt % followed by filtering using a filter paper (product name: No. 5C; manufactured by Toyo Roshi Kaisha, Ltd.). Then, the electrical conductivity of the obtained filtrate was measured by means of a conductance meter (product name: ES-12; manufactured by HORIBA, Ltd.), and the substantial electrical conductivity of the filtrate was calculated from the following Calculation formula 5:

$$\text{Electrical conductivity of filtrate (}\mu\text{S/cm)} = A - B \quad \text{Calculation formula 5:}$$

wherein, "A" is the electrical conductivity (μS/cm) of the measured filtrate; and "B" is the electrical conductivity (μS/cm) of ion-exchanged water.

(5) Particle size Characteristics of Colored Resin Particles (5-1) Volume Average Particle Diameter (Dv), Number Average Particle Diameter (Dn) and Particle Size Distribution (Dv/Dn)

About 0.1 g of colored resin particles was weighed and charged into a beaker. Then, an aqueous solution of alkyl benzene sulfonate (product name: DRIWEL; manufactured by FUJIFILM Corporation) of 0.1 ml was added therein as a dispersant. Further, from 10 to 30 ml of ISOTON II (product name) was added to the beaker. The mixture was dispersed by means of an ultrasonic disperser at 20 watts for three minutes. Then, the volume average particle diameter (Dv) and the number average particle diameter (Dn) of the colored resin particles were measured by means of a particle diameter measuring device (product name: MULTISIZER; manufactured by: Beckman Coulter, Inc.) under the conditions of an aperture diameter of 100 μm, using ISOTON II as a medium, and a number of the measured particles of 100,000. Therefrom, the particle size distribution (Dv/Dn) was calculated.

(5-2) Average Circularity

Into a container pre-filled with ion-exchanged water of 10 ml, a surfactant (alkyl benzene sulfonate) of 0.02 g as a dispersant and colored resin particles of 0.02 g were charged. Then, dispersion treatment was performed by means of an ultrasonic disperser at 60 watts for three minutes. The density of colored resin particles during measurement was adjusted to be 3,000 to 10,000 particles/μL, and 1,000 to 10,000 colored resin particles having a diameter of 0.4 μm or more by a diameter of the equivalent circle were subjected to measurement by means of a flow particle image analyzer (product name: FPIA-2100; manufactured by: Sysmex Co.). The average circularity was calculated from measured values thus obtained.

Circularity can be calculated by the following Calculation formula 2, and the average circularity is an average of calculated circularities:

Circularity=a perimeter of a circle having an area same as a projected area of a particle/a perimeter of a projected image of a particle Calculation formula 2:

(6) Amount (ppm) of Solid Content in Filtrate

At the separation-washing mechanism of Examples A7 to A9, all filtrate discharged through the lower filter cloth was collected. 500 g of the filtrate was sampled from all collected filtrate and filtered using a filter paper (product name: No. 5C; manufactured by Toyo Roshi Kaisha, Ltd.). A residue collected on the filter paper was dried for 2 hours in an oven at 105° C., and the weight (g) of the collected residue was measured. Then, the amount (ppm) of the solid content in the filtrate was calculated by the following Calculation formula 1:

Amount of solid content in filtrate (%)=[weight of collected residue (g)/amount of filtrate (g)]×100 Calculation formula 1:

EXAMPLE A

Example A1

(1) Process of Obtaining Aqueous Dispersion of Colored Resin Particles 75 parts of styrene and 25 parts of n-butyl acrylate as monovinyl monomers, 5 parts of copper phthalocyanine (product name: Chromofine Blue 6352; manufactured by Dainichiseika Colors & Chemicals Mfg. Co., Ltd.) as a cyan colorant, 1 part of charge control resin having positively charging ability (product name: FCA-161P; manufactured by Fujikura Kasei Co., Ltd.; a styrene/acrylate resin) as a charge control agent, and 5 parts of ester wax (product name: WEP-7, manufactured by NOF Corporation) as a release agent were agitated by means of an agitator to mix followed by uniform dispersion. Thus, a polymerizable monomer composition was obtained.

Separately, an aqueous solution of 6.2 parts of sodium hydroxide (alkali hydroxide metal) dissolved in 50 parts of ion-exchanged water was gradually added to an aqueous solution of 11 parts of magnesium chloride (water-soluble polyvalent metallic salt) dissolved in 200 parts of ion-exchanged water at room temperature (25° C.) while agitating to prepare a magnesium hydroxide colloid (hardly water-soluble metal hydroxide colloid) dispersion liquid.

The polymerizable monomer composition was charged into the magnesium hydroxide colloid dispersion liquid thus obtained and agitated at room temperature (25° C.) by means of an agitator furnished with an agitating blade until rough droplets being produced are stable.

Then, 5 parts of t-butylperoxy-2-ethylbutanoate (product name: TRIGONOX 27; manufactured by Akzo Nobel N.V.) as a polymerization initiator, 1 part of tetraethylthiuram disulfide as a molecular weight modifier, and 0.4 parts of divinylbenzene of a crosslinkable polymerizable monomer were added therein. The mixture was subjected to dispersion treatment at a peripheral speed of 40 m/s by means of an in-line type emulsifying and dispersing machine (product name: CAVITRON; manufactured by Pacific Machinery & Engineering Co., Ltd) to form droplets of the polymerizable monomer composition.

In the suspension having droplets of the polymerization monomer composition dispersed (a polymerizable monomer composition dispersion liquid), 0.1 parts of Pyrogallol (product name; manufactured by Wako Pure Chemical Industries, Ltd.) was added as an inhibitor of small diameter microparticle production, and further agitated.

The thus obtained suspension was charged into a reactor furnished with an agitating blade and the temperature thereof was raised to 90° C. to start a polymerization reaction.

When the polymerization conversion rate reached almost 95%, 2.1 parts of methyl methacrylate (a polymerizable monomer for shell) and 0.21 parts of 2,2'-azobis (2-methyl-N-(2-hydroxyethyl)-propionamide) (product name: VA-086; manufactured by Wako Pure Chemical Industries, Ltd.; a polymerization initiator for shell (water soluble)) dissolved in 20 parts of ion-exchanged water were added in the reactor.

After continuing the reaction for 3 hours at 90° C., the reaction was stopped. Thus, an aqueous dispersion of colored resin particles was obtained.

The temperature of the aqueous dispersion of colored resin particles was lowered to 80° C., and nitrogen gas was introduced while agitating to remove volatile material remained in the colored resin particles. Further, the temperature was lowered to 30° C.

The above aqueous dispersion of colored resin particles was subjected to acid washing in which diluted sulfuric acid was added so that pH to be pH 4 at room temperature while stirring. Thereby, a dispersion stabilizer (magnesium hydroxide) was made to be soluble to water. The concentration of solid content of the aqueous dispersion of colored resin particles (pH4) at this stage was 21.5 wt %.

A part of the aqueous dispersion of the colored resin particles after acid washing was sampled to study the glass-transition temperature (Tg) of the colored resin particles. The Tg was 52.2° C.

(2) Process of Obtaining Wet Cake (2-1) Separation-Washing Mechanism

Ion-exchanged water was added to the above aqueous dispersion of colored resin particles (concentration of solid content: 21.5 wt %) and stirred to adjust the concentration of solid content of the aqueous dispersion of colored resin particles to be 13 wt %.

The obtained aqueous dispersion of the colored resin particles (concentration of solid content: 13 wt %) was supplied to the endless lower filter cloth 1 of the filter cloth continuous running type belt filter shown in FIG. 1 under the conditions below. Cleaning water was supplied to the colored resin particles on the lower filter cloth 1. After separation and washing, colored resin particles in wet state (wet cake) were formed.

<Conditions of Separation and Washing>

Supplied amount of aqueous dispersion of colored resin particles: 1.0 $m^3$/hr.

Supplied amount of cleaning water: 0.8 $m^3$/hr.

Filtering area of actual use: 3.5 $m^2$ (effective width 1.0 m×effective length 3.5 m)

Traveling speed of lower filter cloth: 0.6 m/min.

Kind of lower filter cloth: PP-35065-1 (product name; manufactured by Nakao-filter Co., Ltd.)

Material of lower filter cloth: nonwoven cloth having a structure of three layers constituted with a center foundation cloth of polypropylene fiber disposed between polypropylene fibers Ventilation degree of lower filter cloth: 1 cc/$cm^2$·sec.

Tensile strength of lower filter cloth: vertical direction (running direction of filter cloth) of 560 N/cm, and horizontal direction (width direction of filter cloth) of 534 N/cm Degree of vacuum: 40 to 51 kPa (300 to 380 Torr)

The average thickness X of the wet cake formed by the separation-washing mechanism was 6 mm.

Also, a part of the wet cake formed by the separation-washing mechanism was sampled to determine the percentage of moisture content. The percentage of moisture content was 26 wt %.

(2-2) Pressure-Ventilation Mechanism

The wet cake formed by the separation-washing mechanism was covered with the upper filter cloth 2 of the filter cloth continuous running type belt filter shown in FIG. 1, and the wet cake, disposed between the upper and lower filter cloths, was ventilated using compressed air while pressure was applied to the wet cake under the conditions below. Thus, the wet cake having low percentage of moisture content was obtained.

<Conditions of Pressure-Ventilation>

Filtering area of actual use: 3.5 $m^2$ (effective width 1.0 m×effective length 3.5 m)

Traveling speed of upper filter cloth: 0.6 m/min.

Material of upper filter cloth: nonwoven cloth having a single-layer structure made of polyester fiber Ventilation degree of upper filter cloth: 28.3 cc/$cm^2$·sec.

Ventilation time of compressed air: 30 sec.

Pressure of compressed air: 0.4 MPa

Temperature of compressed air: 25° C.

Pressure of the pressurizing surface: 0.5 MPa

A part of the wet cake obtained by the pressure-ventilation mechanism was sampled to measure the average percentage of moisture content. The average percentage of moisture content was 10.1 wt %. Also, a part of the wet cake obtained by the pressure-ventilation mechanism was sampled to measure the electrical conductivity. The electrical conductivity was 7.5 μS/cm.

(3) Process of Drying Wet Cake

The wet cake obtained above (percentage of moisture content: 10.1 wt %) was collected, and charged in a vacuum dryer followed by vacuum drying under the conditions below. Thus, colored resin particles were obtained.

<Conditions of Drying>

Degree of vacuum: 6.67 kPa (50 Torr)

Temperature of jacket: 50° C.

A part of the colored resin particles obtained by drying was sampled to measure the particle size characteristics of the colored resin particles. The volume average particle diameter (Dv) was 7.8 μm, the particle size distribution (Dv/Dn) was 1.18, and the average circularity was 0.980.

(4) External Addition Process

To 100 parts of the above obtained colored resin particles, 0.5 parts of silica particles (product name: TG820F; manufactured by Cabot Corporation; number average primary particle diameter: 7 nm) subjected to hydrophobicity-imparting treatment by cyclic silazane and 1.0 part of silica particles (product name: NA50Y; manufactured by Nippon Aerosil Co., Ltd.; number average primary particle diameter: 40 nm) subjected to hydrophobicity-imparting treatment by polymethylsiloxane and aminosilane were added as external additives, and mixed by means of a high speed agitator (product name: FM MIXER; manufactured by NIPPON COKE & ENGINEERING CO., LTD.) to perform external addition treatment. Thus, a toner of Example A1 was produced and used for testing.

Example A2

A toner of Example A2 was produced and tested similarly as Example A1 except that the supplied amount of the aqueous dispersion of colored resin particles in the separation-washing mechanism of Example A1 was changed from 1.0 $m^3$/hr. to 2.0 $m^3$/hr.

Example A3

A toner of Example A3 was produced and tested similarly as Example A1 except that the supplied amount of the aqueous dispersion of colored resin particles in the separation-washing mechanism of Example A1 was changed from 1.0 $m^3$/hr. to 2.0 $m^3$/hr., and the ventilation time of compressed air in the pressure-ventilation mechanism of Example A1 was changed from 30 sec. to 20 sec.

Example A4

A toner of Example A4 was produced and tested similarly as Example A1 except that the ventilation time of compressed air in the pressure-ventilation mechanism of Example A1 was changed from 30 sec. to 90 sec.

Example A5

A toner of Example A5 was produced and tested similarly as Example A1 except that the temperature of the compressed air in the pressure-ventilation mechanism of Example A1 was changed from 25° C. to 42° C.

Example A6

A toner of Example A6 was produced and tested similarly as Example A1 except that, in the pressure-ventilation mechanism of Example A1, the pressure of the compressed air was changed from 0.4 MPa to 0.3 MPa, and the pressure of the pressurizing surface was changed from 0.5 MPa to 0.4 MPa.

Example A7

In the process of obtaining the aqueous dispersion of colored resin particles of Example A1, it was changed that an aqueous solution of 6.9 parts of sodium hydroxide dissolved in 50 parts of ion-exchanged water was gradually added to an aqueous solution of 12.3 parts of magnesium chloride dissolved in 200 parts of ion-exchanged water at room temperature (25° C.) while stirring, and thus a magnesium hydroxide colloid dispersion liquid was prepared. It was also changed that ion-exchanged water was added to the aqueous dispersion of colored resin particles (pH4) having a concentration of solid content after acid washing of 15.8 wt % and agitated to adjust the concentration of solid content of the aqueous dispersion of colored resin particles to be 13 wt %.

Also, in the separation-washing mechanism of Example A1, it was changed that the wet cake is supplied on the endless lower cloth 1 of the filter cloth continuous running type belt filter shown in FIG. 2. under the following conditions.

<Conditions of Separation and Washing>

Supplied amount of aqueous dispersion of colored resin particles: 0.4 $m^3$/hr.

Supplied amount of cleaning water: 0.25 $m^3$/hr.

Filtering area of actual use: 0.7 $m^2$ (effective width 0.25 m×effective length 2.8 m)

Traveling speed of lower filter cloth: 1.2 m/min.

Degree of vacuum: 21 kPa (158 Torr)

Further, similarly as Example A1, a toner of Example A7 was produced and tested except that, in the pressure-ventilation mechanism of Example A1, the upper filter cloth and seal belt were layered in the filter cloth continuous running type belt filter shown in FIG. 2 under the following conditions.

<Conditions of Pressure-Ventilation>

Filtering area of actual use: 0.7 $m^2$ (effective width 0.25 m×effective length 2.8 m)

Traveling speed of upper filter cloth: 1.2 m/min.

Traveling speed of seal belt: 1.2 m/min.

Material of upper filter cloth: nonwoven cloth having a single-layer structure made of polypropylene fiber Ventilation degree of upper filter cloth: 1.3 cc/$cm^2$·sec.

Pressure of compressed air: 0.3 MPa

Example A8

Similarly as Example A7, a toner of Example A8 was produced and tested except that, in the separation-washing mechanism of Example A7, the kind of lower filter cloth was changed from PP-35065-1 manufactured by Nakao-filter Co., Ltd. to WN700PS (product name; manufactured by Tsukishima Kikai Co., Ltd.; material: nonwoven cloth having a structure of three layers constituted with a center foundation cloth of polyester fiber disposed between mixed fibers of polypropylene and polyethylene; ventilation degree: 0.6 cc/$cm^2$·sec.; and tensile strength: vertical direction (running direction of filter cloth): 690 N/cm and horizontal direction (width direction of filter cloth): 702 N/cm).

Example A9

Similarly as Example A8, a toner of Example A9 was produced and tested except that, in the pressure-ventilation mechanism of Example A8, the temperature of compressed air was changed from 25° C. to 42° C.

Comparative Example A1

A toner of Comparative example A1 was produced and tested similarly as Example A1 except that the pressure-ventilation mechanism was not provided in the separation-washing mechanism.

(Results)

Test results of toners produced in Examples A1 to A9 and Comparative example A1 are shown in Tables 1-1, 1-2, 2-1 and 2-2.

TABLE 1-1

| | Example A1 | Example A2 | Example A3 | Example A4 | Example A5 |
|---|---|---|---|---|---|
| (Separation-washing mechanism) | | | | | |
| Supplied amount of aqueous dispersion of colored resin particles ($m^3$/hr) | 1.0 | 2.0 | 2.0 | 1.0 | 1.0 |
| Supplied amount of cleaning water ($m^3$/hr) | 0.8 | 0.8 | 0.8 | 0.8 | 0.8 |
| Average thickness X (mm) of wet cake | 6 | 12 | 12 | 6 | 6 |
| Percentage of moisture content after separation and washing (%) | 26 | 34 | 34 | 26 | 26 |
| (Pressure-ventilation mechanism) | | | | | |
| Presence of pressure-ventilation mechanism | yes | yes | yes | yes | yes |
| Ventilation time of compressed air (sec.) | 30 | 30 | 20 | 90 | 30 |
| Pressure of compressed air (MPa) | 0.4 | 0.4 | 0.4 | 0.4 | 0.4 |
| Temperature of compressed air (° C.) | 25 | 25 | 25 | 25 | 42 |
| Pressure of pressurizing surface (MPa) | 0.5 | 0.5 | 0.5 | 0.5 | 0.5 |
| (Wet cake obtained by pressure-ventilation mechanism) | | | | | |
| Average percentage of moisture content of wet cake (%) | 10.1 | 16.4 | 21.0 | 9.5 | 9.2 |
| Electrical conductivity of filtrate of wet cake (μS/cm) | 7.5 | 13.5 | 18.3 | 9.3 | 7.2 |

TABLE 1-2

| | Example A6 | Example A7 | Example A8 | Example A9 | Comp. example A1 |
|---|---|---|---|---|---|
| (Separation-washing mechanism) | | | | | |
| Supplied amount of aqueous dispersion of colored resin particles ($m^3$/hr) | 1.0 | 0.4 | 0.4 | 0.4 | 1.0 |
| Supplied amount of cleaning water ($m^3$/hr) | 0.8 | 0.25 | 0.25 | 0.25 | 0.8 |
| Average thickness X (mm) of wet cake | 6 | 5 | 5 | 5 | 6 |
| Percentage of moisture content after separation and washing (%) | 26 | 35.6 | 35.6 | 35.2 | 26 |
| (Pressure-ventilation mechanism) | | | | | |
| Presence of pressure-ventilation mechanism | yes | yes | yes | yes | no |
| Ventilation time of compressed air (sec.) | 30 | 30 | 30 | 30 | — |
| Pressure of compressed air (MPa) | 0.3 | 0.3 | 0.3 | 0.3 | — |
| Temperature of compressed air (° C.) | 25 | 25 | 25 | 42 | — |
| Pressure of pressurizing surface (MPa) | 0.4 | 0.5 | 0.5 | 0.5 | — |
| (Wet cake obtained by pressure-ventilation mechanism) | | | | | |
| Average percentage of moisture content of wet cake (%) | 14.3 | 17.6 | 18.2 | 16.2 | 26.0 |
| Electrical conductivity of filtrate of wet cake (μS/cm) | 12.3 | 12.8 | 15.7 | 10.8 | 24.3 |

TABLE 2-1

| | | Example A1 | Example A2 | Example A3 | Example A4 | Example A5 |
|---|---|---|---|---|---|---|
| Kind of filter cloth continuous running type belt filter | | FIG. 1 | FIG. 1 | FIG. 1 | FIG. 1 | FIG. 1 |
| Kind of lower filter cloth | | PP-35065-1 | PP-35065-1 | PP-35065-1 | PP-35065-1 | PP-35065-1 |
| Material of lower filter cloth | Structure | Nonwoven cloth having a structure of three layers | Nonwoven cloth having a structure of three layers | Nonwoven cloth having a structure of three layers | Nonwoven cloth having a structure of three layers | Nonwoven cloth having a structure of three layers |
| | Center foundation cloth | Polypropylene fiber | Polypropylene fiber | Polypropylene fiber | Polypropylene fiber | Polypropylene fiber |
| | Above and below center foundation cloth | Polypropylene fiber | Polypropylene fiber | Polypropylene fiber | Polypropylene fiber | Polypropylene fiber |
| Ventilation degree of lower filter cloth ($cc/cm^2 \cdot sec.$) | | 1 | 1 | 1 | 1 | 1 |
| Tensile strength of lower filter cloth (N/cm) | | Vertical: 560 Horizontal: 534 | Vertical: 560 Horizontal: 534 | Vertical: 560 Horizontal: 534 | Vertical: 560 Horizontal: 534 | Vertical: 560 Horizontal: 534 |
| Amount of solid content in collected filtrate (ppm) | | — | — | — | — | — |
| Dv of colored resin particles after drying | | 7.8 | 7.8 | 7.8 | 7.8 | 7.8 |
| Dv/Dn of colored resin particles after drying | | 1.18 | 1.18 | 1.18 | 1.18 | 1.18 |
| Average circularity of the colored resin particles after drying | | 0.980 | 0.980 | 0.980 | 0.980 | 0.980 |

TABLE 2-2

| | | Example A6 | Example A7 | Example A8 | Example A9 | Comp. example A1 |
|---|---|---|---|---|---|---|
| Kind of filter cloth continuous running type belt filter | | FIG. 1 | FIG. 2 | FIG. 2 | FIG. 2 | FIG. 1 |
| Kind of lower filter cloth | | PP-35065-1 | PP-35065-1 | WN700PS | WN700PS | PP-35065-1 |
| Material of lower filter cloth | Structure | Nonwoven cloth having a structure of three layers | Nonwoven cloth having a structure of three layers | Nonwoven cloth having a structure of three layers | Nonwoven cloth having a structure of three layers | Nonwoven cloth having a structure of three layers |
| | Center foundation cloth | Polypropylene fiber | Polypropylene fiber | Polyester fiber | Polyester fiber | Polypropylene fiber |
| | Above and below center foundation cloth | Polypropylene fiber | Polypropylene fiber | Mixed fiber of polypropylene and polyethylene | Mixed fiber of polypropylene and polyethylene | Polypropylene fiber |

TABLE 2-2-continued

| | Example A6 | Example A7 | Example A8 | Example A9 | Comp. example A1 |
|---|---|---|---|---|---|
| Ventilation degree of lower filter cloth ($cc/cm^2 \cdot sec.$) | 1 | 1 | 0.6 | 0.6 | 1 |
| Tensile strength of lower filter cloth (N/cm) | Vertical: 560 Horizontal: 534 | Vertical: 560 Horizontal: 534 | Vertical: 690 Horizontal: 702 | Vertical: 690 Horizontal: 702 | Vertical: 560 Horizontal: 534 |
| Amount of solid content in collected filtrate (ppm) | — | 131 | 35 | 38 | — |
| Dv of colored resin particles after drying | 7.8 | 7 | 7 | 7 | 7.8 |
| Dv/Dn of colored resin particles after drying | 1.18 | 1.17 | 1.17 | 1.17 | 1.18 |
| Average circularity of the colored resin particles after drying | 0.980 | 0.981 | 0.981 | 0.981 | 0.980 |

(Summary of Results)

The test results of Tables 1-1 and 1-2 show the following.

It was confirmed that the percentage of moisture content was not sufficiently decreased and washing of the colored resin particles was not sufficient in the method of producing the toner of Comparative example A1 since the pressure-ventilation mechanism specified in the present invention was not provided in "Process of obtaining wet cake".

To the contrary, it was confirmed that the percentage of moisture content was sufficiently decreased and washing of the colored resin particles was sufficient in the methods of producing the toner of Examples A1 to A9 since the separation-washing mechanism, and pressure-ventilation mechanism specified in the present invention were provided in "Process of obtaining wet cake".

Further, it was confirmed that the amount of solid content (amount of colored resin particles) in the collected filtrate was significantly small and filtration performance of the lower filter cloth was high in the methods of producing the toner of Examples A8 and A9 since WN700PS manufactured by Tsukishima Kikai Co., Ltd. was used. Thus, the effect of improving yield of colored resin particles was obtained.

EXAMPLE B

Example B1

A toner of Example B1 was produced and tested similarly as Example A1 except that the pressure-ventilation mechanism of Example A1 was changed to the following pressure-ventilation mechanism.

The wet cake formed by the separation-washing mechanism of Example A1 was covered with the upper filter cloth of the filter cloth continuous running type belt filter shown in FIG. 1, and the area, excluding both edges in the width direction of the belt filter, of the wet cake, disposed between the upper and lower filter cloths, was ventilated using compressed air while pressure was applied to the wet cake under the conditions below. Thus, a wet cake having low percentage of moisture content was obtained.

<Conditions of Pressure-Ventilation>

Filtering area of actual use: 3.5 $m^2$ (effective width 1 m×effective length 3.5 m)

Traveling speed of upper filter cloth: 0.6 m/min.

Material of upper filter cloth: nonwoven cloth made of polyester

Ventilation degree of upper filter cloth: 28.3 $cc/cm^2 \cdot sec.$

Distance Y from each edge of the wet cake not subjected to ventilation: 20 mm

Ventilation time: 30 sec.

Ventilation temperature: 25° C.

Pressure of the pressurizing surface: 0.4 MPa

The percentage of moisture content of each region of the wet cake obtained by the pressure-ventilation mechanism was measured. The percentage of moisture content of about 1 cm from the edge of the wet cake was 18 wt %. The percentage of moisture content of the center area of the wet cake was 5 wt %. The average percentage of moisture content of the wet cake was 11.0 wt %.

Further, a part of the wet cake obtained by the pressure-ventilation mechanism was sampled to measure the electrical conductivity. The electrical conductivity was 7.5 μS/cm.

Example B2

A toner of Example B2 was produced and tested similarly as Example B1 except that the supplied amount of the aqueous dispersion of colored resin particles in the separation-washing mechanism of Example B1 was changed from 1.0 $m^3/hr$ to 3.0 $m^3/hr$, and further, in the pressure-ventilation mechanism of Example B1, the distance Y from each edge of the wet cake not subjected to ventilation was changed from 20 mm to 30 mm, the ventilation pressure Z was changed from 0.4 MPa to 0.8 MPa, and the pressure of the pressurizing surface was changed from 0.4 MPa to 0.9 MPa.

Example B3

A toner of Example B3 was produced and tested similarly as Example B1 except that the supplied amount of the aqueous dispersion of colored resin particles in the separation-washing mechanism of Example B1 was changed from 1.0 $m^3/hr$ to 1.5 $m^3/hr$, and the pressure of the pressurizing surface in the pressure-ventilation mechanism of Example B1 was changed from 0.4 MPa to 0.6 MPa.

Example B4

A toner of Example B4 was produced and tested similarly as Example B1 except that the ventilation time in the pressure-ventilation mechanism of Example B1 was changed from 30 sec. to 12 sec.

Example B5

A toner of Example B5 was produced and tested similarly as Example B1 except that the supplied amount of the aqueous dispersion of colored resin particles in the separation-washing mechanism of Example B1 was changed from 1.0 $m^3/hr$ to 3.0 $m^3/hr$, and further, in the pressure-ventilation mechanism of Example B1, the distance Y from each edge of the wet cake not subjected to ventilation was changed from 20 mm to 30 mm, the ventilation pressure Z was changed from 0.4 MPa to 0.8 MPa, the ventilation time was changed from 30 sec. to 90 sec., and the pressure of the pressurizing surface was changed from 0.4 MPa to 0.8 MPa.

Example B6

A toner of Example B6 was produced and tested similarly as Example B1 except that the ventilation pressure Z in the pressure-ventilation mechanism of Example B1 was changed from 0.4 MPa to 0.3 MPa.

Example B7

A toner of Example B7 was produced and tested similarly as Example B1 except that, in the separation-washing mechanism of Example B1, the Traveling speed of the lower filter cloth was changed from 0.6 m/min. to 0.2 m/min. and degree of vacuum was changed "from 300 to 380 Torr" to "from 380 to 460 Torr", and further, in the pressure-ventilation mechanism of Example B1, the distance Y from each edge of the wet cake not subjected to ventilation was changed from 20 mm to 30 mm, the ventilation pressure Z was changed from 0.4 MPa to 0.8 MPa, the ventilation time was changed from 30 sec. to 135 sec., and the pressure of the pressurizing surface was changed from 0.4 MPa to 0.9 MPa.

Example B8

A toner of Example B8 was produced and tested similarly as Example B1 except that the supplied amount of the aqueous dispersion of colored resin particles in the separation-washing mechanism of Example B1 was changed from 1.0 $m^3$/hr to 3.0 $m^3$/hr, and further, in the pressure-ventilation mechanism of Example B1, the distance Y from each edge of the wet cake not subjected to ventilation was changed from 20 mm to 28 mm, the ventilation pressure Z was changed from 0.4 MPa to 0.15 MPa, the ventilation time was changed from 30 sec. to 240 sec., and the pressure of the pressurizing surface was changed from 0.4 MPa to 0.9 MPa.

Example B9

A toner of Example B9 was produced and tested similarly as Example B1 except that the supplied amount of the aqueous dispersion of colored resin particles in the separation-washing mechanism of Example B1 was changed from 1.0 $m^3$/hr to 4.0 $m^3$/hr, and further, in the pressure-ventilation mechanism of Example B1, the distance Y from each edge of the wet cake not subjected to ventilation was changed from 20 mm to 40 mm, the ventilation pressure Z was changed from 0.4 MPa to 1.1 MPa, the ventilation time was changed from 30 sec. to 240 sec., the ventilation temperature was changed from 25° C. to 30° C., and the pressure of the pressurizing surface was changed from 0.4 MPa to 1.2 MPa.

Comparative Example B1

A toner of Comparative example B1 was produced and tested similarly as Example B1 except that, in the pressure-ventilation mechanism of Example B1, the distance Y from each edge of the wet cake not subjected to ventilation was changed from 20 mm to 10 mm and the pressure of the pressurizing surface was changed from 0.4 MPa to 0.9 MPa.

Comparative Example B2

A toner of Comparative example B2 was produced and tested similarly as Example B1 except that, in the separation-washing mechanism of Example B1, the supplied amount of the aqueous dispersion of colored resin particles was changed from 1.0 $m^3$/hr to 1.5 $m^3$/hr and the degree of vacuum was changed from "300 to 380 Torr" to "460 to 540 Torr", and further, in the pressure-ventilation mechanism of Example B1, the ventilation pressure Z was changed from 0.4 MPa to 0.6 MPa and the pressure of the pressurizing surface was changed from 0.4 MPa to 0.6 MPa.

Comparative Example B3

A toner of Comparative example B3 was produced and tested similarly as Example B1 except that, in the separation-washing mechanism of Example B1, the traveling speed of the lower filter cloth was changed from 0.6 m/min. to 0.1 m/min., and further, in the pressure-ventilation mechanism of Example B1, the ventilation pressure Z was changed from 0.4 MPa to 0.6 MPa and the pressure of the pressurizing surface was changed from 0.4 MPa to 0.6 MPa.

Comparative Example B4

A toner of Comparative example B4 was produced and tested similarly as Example B1 except that, the supplied amount of the aqueous dispersion of colored resin particles in the separation-washing mechanism of Example B1 was changed from 1.0 $m^3$/hr to 1.5 $m^3$/hr, and further, in the pressure-ventilation mechanism of Example B1, the ventilation time was changed from 30 sec. to 8 sec. and the pressure of the pressurizing surface was changed from 0.4 MPa to 0.6 MPa.

Comparative Example B5

A toner of Comparative example B5 was produced and tested similarly as Example B1 except that, in the pressure-ventilation mechanism of Example B1, the ventilation pressure Z was changed from 0.4 MPa to 0.1 MPa, the ventilation time was changed from 30 sec. to 90 sec., and the pressure of the pressurizing surface was changed from 0.4 MPa to 0.2 MPa.

(Results)

Test results of toners produced in Example B1 to B9 are shown in Table 3, and test results of toners produced in Comparative example B1 to B5 are shown in Table 4.

TABLE 3

| | Ex. B1 | Ex. B2 | Ex. B3 | Ex. B4 | Ex. B5 | Ex. B6 | Ex. B7 | Ex. B8 | Ex. B9 |
|---|---|---|---|---|---|---|---|---|---|
| (Conditions of separation and washing) | | | | | | | | | |
| Concentration of solid content of aqueous dispersion of colored resin particles (wt %) | 13 | 13 | 13 | 13 | 13 | 13 | 13 | 13 | 13 |
| Supplied amount of aqueous dispersion of colored resin particles ($m^3$/hr) | 1.0 | 3.0 | 1.5 | 1.0 | 3.0 | 1.0 | 1.0 | 3.0 | 4.0 |

TABLE 3-continued

| | Ex. B1 | Ex. B2 | Ex. B3 | Ex. B4 | Ex. B5 | Ex. B6 | Ex. B7 | Ex. B8 | Ex. B9 |
|---|---|---|---|---|---|---|---|---|---|
| Supplied amount of cleaning water ($m^3$/hr) | 0.8 | 0.8 | 0.8 | 0.8 | 0.8 | 0.8 | 0.8 | 0.8 | 0.8 |
| Traveling speed of lower filter cloth (m/min) | 0.6 | 0.6 | 0.6 | 0.6 | 0.6 | 0.6 | 0.2 | 0.6 | 0.6 |
| Degree of vacuum (Torr) | 300 to 380 | 300 to 380 | 300 to 380 | 300 to 380 | 300 to 380 | 300 to 380 | 380 to 460 | 300 to 380 | 300 to 380 |
| (Wet cake formed by separation-washing mechanism) | | | | | | | | | |
| Percentage of moisture content of wet cake (%) | 26 | 38 | 33 | 26 | 38 | 26 | 43 | 38 | 43 |
| Average thickness X of wet cake (mm) | 6 | 18 | 9 | 6 | 18 | 6 | 18 | 18 | 24 |
| (Conditions of pressure-ventilation) | | | | | | | | | |
| Distance Y from each edge of wet cake not subjected to ventilation (mm) | 20 | 30 | 20 | 20 | 30 | 20 | 30 | 28 | 40 |
| Ventilation pressure Z (MPa) | 0.4 | 0.8 | 0.4 | 0.4 | 0.8 | 0.3 | 0.8 | 0.15 | 1.1 |
| Ventilation time (sec) | 30 | 30 | 30 | 12 | 90 | 30 | 135 | 240 | 240 |
| Ventilation temperature (° C.) | 25 | 25 | 25 | 25 | 25 | 25 | 25 | 25 | 30 |
| Pressure of pressurizing surface (MPa) | 0.4 | 0.9 | 0.6 | 0.4 | 0.8 | 0.4 | 0.9 | 0.9 | 1.2 |
| (Wet cake obtained by pressure-ventilation mechanism) | | | | | | | | | |
| Percentage of moisture content of a part about 1 cm from edge of wet cake (%) | 18 | 30 | 26 | 25 | 30 | 22 | 35 | 25 | 35 |
| Percentage of moisture content of center area of wet cake (%) | 5 | 8 | 6 | 5 | 8 | 7 | 6 | 8 | 8 |
| Average percentage of moisture content of wet cake (%) | 11.0 | 17.4 | 13.0 | 17.6 | 18.4 | 14.3 | 19.4 | 18.7 | 19.0 |
| Electrical conductivity of filtrate of wet cake (μS/cm) | 7.5 | 13.5 | 7.5 | 7.5 | 13.5 | 12.3 | 13.5 | 13.5 | 9.8 |

TABLE 4

| | Comp. ex. B1 | Comp. ex. B2 | Comp. ex. B3 | Comp. ex. B4 | Comp. ex. B5 |
|---|---|---|---|---|---|
| (Conditions of separation and washing) | | | | | |
| Concentration of solid content of aqueous dispersion of colored resin particles (wt %) | 13 | 13 | 13 | 13 | 13 |
| Supplied amount of aqueous dispersion of colored resin particles ($m^3$/hr) | 1.0 | 1.5 | 1.0 | 1.5 | 1.0 |
| Supplied amount of cleaning water ($m^3$/hr) | 0.8 | 0.8 | 0.8 | 0.8 | 0.8 |
| Traveling speed of lower filter cloth (m/min) | 0.6 | 0.6 | 0.1 | 0.6 | 0.6 |
| Degree of vacuum (Torr) | 300 to 380 | 460 to 540 | 300 to 380 | 300 to 380 | 300 to 380 |
| (Wet cake formed by separation-washing mechanism) | | | | | |
| Percentage of moisture content of wet cake (%) | 26 | 52 | 33 | 33 | 26 |
| Average thickness X of wet cake (mm) | 6 | 9 | 32 | 9 | 6 |
| (Conditions of pressure-ventilation) | | | | | |
| Distance Y from each edge of wet cake not subjected to ventilation (mm) | 10 | 20 | 20 | 20 | 20 |
| Ventilation pressure Z (MPa) | 0.4 | 0.6 | 0.6 | 0.4 | 0.1 |
| Ventilation time (sec) | 30 | 30 | 30 | 8 | 90 |
| Ventilation temperature (° C.) | 25 | 25 | 25 | 25 | 25 |
| Pressure of pressurizing surface (MPa) | 0.9 | 0.6 | 0.6 | 0.6 | 0.2 |
| (Wet cake obtained by pressure-ventilation mechanism) | | | | | |
| Percentage of moisture content of a part about 1 cm from edge of wet cake (%) | — | — | — | 26 | 42 |
| Percentage of moisture content of center area of wet cake (%) | — | — | — | 16 | 25 |
| Average percentage of moisture content of wet cake (%) | 10.1 | — | — | 27.0 | 35.1 |
| Electrical conductivity of filtrate of wet cake (μS/cm) | 7.5 | 7.5 | 7.5 | 7.5 | 25.6 |

(Summary of Results)

The test results of Tables 3 and 4 show the following.

In the method of producing the toner of Comparative example B1, the effect of sealing both edges of the wet cake was not sufficiently obtained, and the wet cake leaked from the edge of the filter cloth since the distance Y from each edge of the wet cake not subjected to ventilation was short in the pressure-ventilation mechanism.

In the method of producing the toner of Comparative example B2, the wet cake fluidized and leaked from the edge of the filter cloth since the wet cake was provided to the pressure-ventilation mechanism without decreasing the percentage of moisture content to the specific amount or less in the separation-washing mechanism.

In the method of producing the toner of Comparative example B3, the effect of sealing both edges of the wet cake exceeded the acceptable range and the wet cake leaked from the edge of the filter cloths since the wet cake having the average thickness over the specific amount was provided to the pressure-ventilation mechanism in the separation-washing mechanism.

In the method of producing the toner of Comparative example B4, the percentage of moisture content of the wet cake could not be sufficiently decreased since the ventilation time was short in the pressure-ventilation mechanism.

In the method of producing the toner of Comparative example B5, the percentage of moisture content of the wet cake could not be sufficiently reduced since the ventilation pressure and the pressure applied on the pressurizing surface were not sufficient in the pressure-ventilation mechanism.

To the contrary, in the methods of producing the toner of Example B1 to B9, it was confirmed that the percentage of moisture content was sufficiently decreased and washing of the colored resin particles was sufficiently performed since the separation-washing mechanism and pressure-ventilation mechanism specified in the present invention were provided in "Process of obtaining wet cake".

What is claimed is:

1. A method for producing a toner, comprising the steps of:

obtaining an aqueous dispersion of colored resin particles by forming the colored resin particles by a wet method;

obtaining the colored resin particles in wet state (wet cake) by supplying the aqueous dispersion of the colored resin particles to a belt filter and performing solid-liquid separation; and drying the wet cake, wherein a filter-cloth-continuous-running-type belt filter is used as the belt filter in the step of obtaining the wet cake, the filter comprising an lower endless filter cloth and an upper endless filter cloth which are tightly stretched by rollers; and the filter-cloth-continuous-running-type belt filter has a separation-washing mechanism, in which the aqueous dispersion of the colored resin particles is supplied on to the lower endless filter cloth of the belt filter, and the colored resin particles are separated and then washed to form the wet cake; and the filter-cloth-continuous-running-type belt filter has a pressure-ventilation roller which is one of the rollers and on which the wet cake is sandwitched by the upper endless filter cloth and the lower endless filter cloth, wound, pressed, and then, ventilated by gas supplied from a ventilation means of the pressure-ventilation roller, thus obtaining the wet cake having a low percentage of moisture content.

2. The method for producing a toner according to claim 1, wherein a ventilation degree of the lower endless filter cloth of the filter-cloth-continuous-running-type belt filter is in the range from 0.1 to 10 $cc/cm^2 \cdot sec$.

3. The method for producing a toner according to claim 1, wherein tensile strength of the lower endless filter cloth of the filter-cloth-continuous-running-type belt filter is in the range from 150 to 1,200 N/cm in running direction and width direction of the lower endless filter cloth respectively.

4. The method for producing a toner according to claim 1, wherein a percentage of moisture content of the wet cake formed by the separation-washing mechanism is in the range from 25 to 45 wt %, and average thickness X of the wet cake formed by the separation-washing mechanism is in the range from 1 to 30 mm.

5. The method for producing a toner according to claim 1, wherein, on the pressure-ventilation roller, pressure on a pressurizing surface is in the range from 0.2 to 1.5 MPa.

6. The method for producing a toner according to claim 1, wherein, on the pressure-ventilation roller, an area to ventilate the wet cake is an area excluding 15 mm or more from both edges of the wet cake in a width direction.

7. The method for producing a toner according to claim 1, wherein, on the pressure-ventilation roller, gas used for ventilation is compressed air.

8. The method for producing a toner according to claim 1, wherein, on the pressure-ventilation roller, pressure of gas used for ventilation is 0.2 to 1.5 MPa.

9. The method for producing a toner according to claim 1, wherein, on the pressure-ventilation roller, ventilation is performed at pressure of gas used for ventilation of 0.2 to 1.5 MPa for 10 to 150 seconds.

10. The method for producing a toner according to claim 1, wherein, on the pressure-ventilation roller, a relationship between temperature $T_1$ (° C.) of gas used for ventilation and glass-transition temperature Tg (° C.) of the colored resin particles is "$Tg-35° C. < T_1 < Tg+20° C.$".

11. The method for producing a toner according to claim 1, wherein an average percentage of moisture content of the wet cake obtained by the pressure-ventilation roller is 20 wt % or less.

12. The method for producing a toner according to claim 1, wherein electrical conductivity of a filtrate, obtained by dispersing the wet cake obtained by the pressure-ventilation roller in ion-exchanged water to prepare a dispersion liquid of the colored resin particles having a concentration of solid content of 20 wt %, and filtering the dispersion liquid, is 0.5 to 20 μS/cm.

13. The method for producing a toner according to claim 1, wherein a ventilation degree of the lower endless filter cloth is in the range from 0.1 to 10 $cc/cm^2 \cdot sec$, and wherein a ventilation degree of the upper endless filter cloth is in the range from 1 to 50 $cc/cm^2 \cdot sec$.

* * * * *